US005899842A

United States Patent [19]

Di Pilla

[11] Patent Number: 5,899,842

[45] Date of Patent: May 4, 1999

[54] METHOD FOR FOLDING PLANE SURFACES

[75] Inventor: Luciano Di Pilla, Monterotondo, Italy

[73] Assignee: Ancan S.r.l., Rome, Italy

[21] Appl. No.: 08/515,349

[22] Filed: Aug. 15, 1995

[51] Int. Cl.[6] ..... B65D 5/36; B31B 1/36

[52] U.S. Cl. ..... 493/405; 493/399; 493/458; 493/940; 493/968

[58] Field of Search ..... 493/405, 395, 493/396, 397, 399, 462, 465, 464, 458, 480, 940, 960, 968

[56] References Cited

U.S. PATENT DOCUMENTS

| | | | |
|---|---|---|---|
| 2,680,998 | 6/1954 | McMillan | 493/940 |
| 2,696,768 | 12/1954 | Mickey | 493/940 |
| 2,709,950 | 6/1955 | Foster | 493/940 |
| 2,901,951 | 9/1959 | Hochfeld | 493/463 |
| 2,915,109 | 12/1959 | Walton | 493/480 |
| 3,242,828 | 3/1966 | Larkin | 493/463 |
| 3,434,400 | 3/1969 | Hochfeld | 93/84 |
| 3,859,897 | 1/1975 | Higa | 493/464 |
| 3,938,244 | 2/1976 | Merle | 493/940 |
| 4,012,932 | 3/1977 | Gewiss | 493/463 |
| 4,227,334 | 10/1980 | Hooker | 493/968 |
| 4,540,390 | 9/1985 | Thorschmidt | 493/23 |
| 4,659,323 | 4/1987 | Ito | 493/463 |
| 5,316,819 | 5/1994 | Nemoto | 493/940 |
| 5,558,951 | 9/1996 | Nemoto | 493/940 |
| 5,593,755 | 1/1997 | Fuss | 493/397 |
| 5,658,230 | 8/1997 | Schweizer | 493/405 |

FOREIGN PATENT DOCUMENTS

| | | |
|---|---|---|
| 2558106 | 7/1985 | France . |
| 2579135 | 9/1986 | France . |
| 2710005 | 3/1995 | France . |
| 9502353 | 1/1995 | WIPO . |

*Primary Examiner*—John Sipos
*Assistant Examiner*—Christopher W. Day
*Attorney, Agent, or Firm*—Abelman, Frayne & Schwab

[57] ABSTRACT

Method for folding plane surfaces wherein, given a plane surface on which there are identified a pluratity of alternative primary folding lines and, parallel to each other and capable to generate a wavy structure, each primary folding line is linked to the subsequent primary folding line by means of two further secondary folding lines, having same origin on the folding line and diverging between them them with angles β and Γ with respect to the perpendicular to the lines, being $0 \leqq \beta < 90°$ and $\beta < \Gamma < 90°$, said joining being performed at least once, then two additional secondary folding lines, corresponding to the previous and, being traced, specular with respect to a simmetry plane passing through the said primary folding line.

22 Claims, 25 Drawing Sheets

FIG.6a
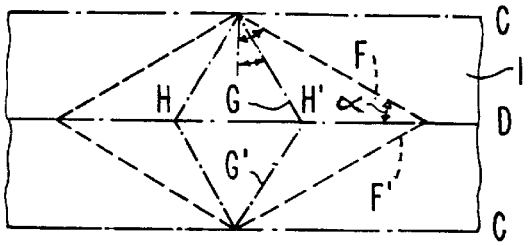
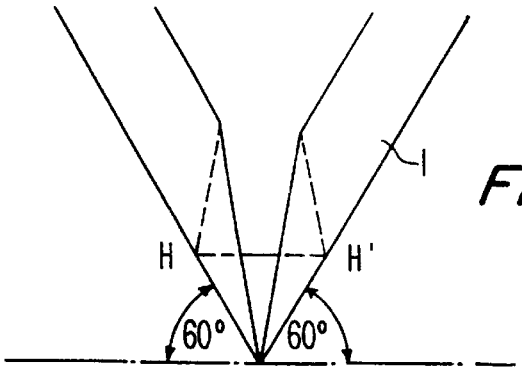
FIG.6b
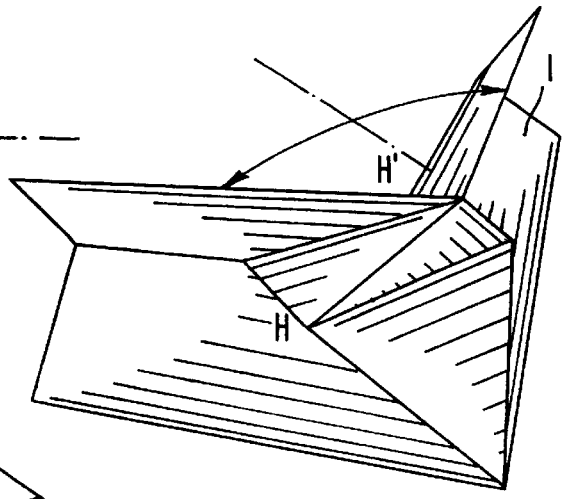
FIG.6c
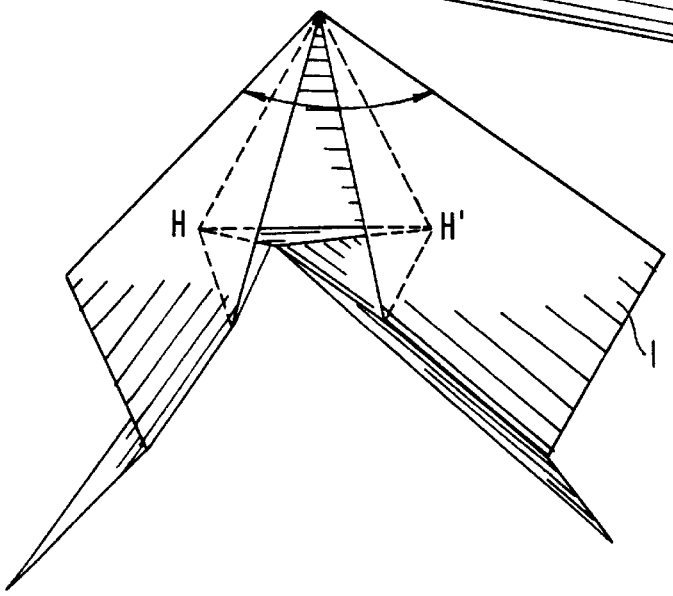
FIG.6d

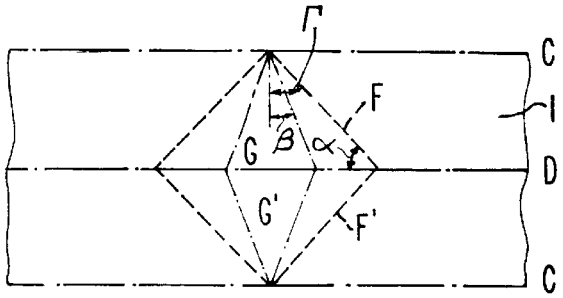
FIG. 6'a
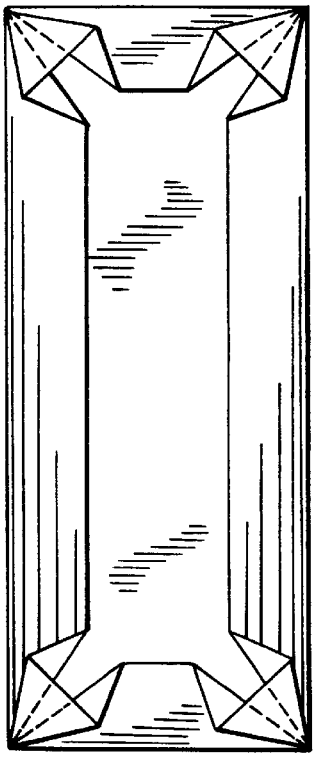
FIG. 6'c
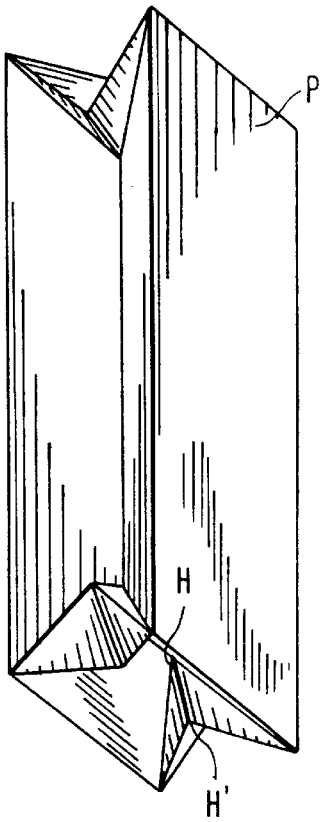
FIG. 6'b
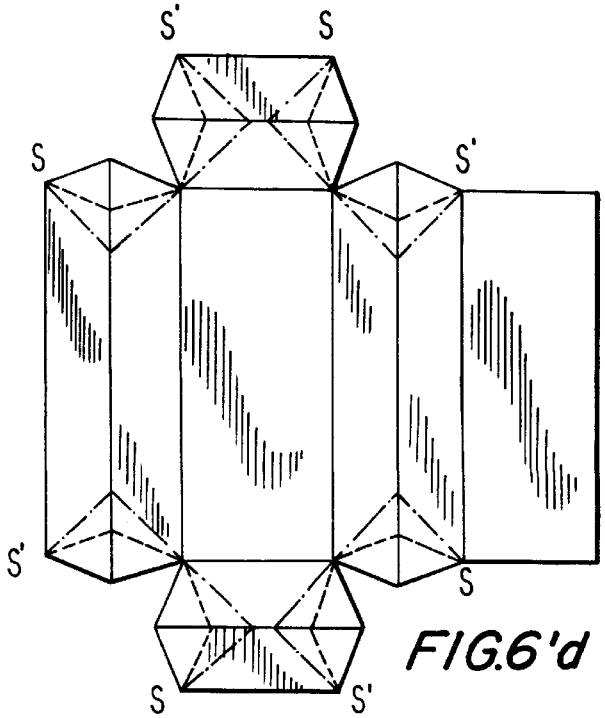
FIG. 6'd

METHOD FOR FOLDING PLANE SURFACES

FIELD OF THE INVENTION

The present invention relates to a method for folding plane surfaces, particularly plane continuous surfaces. According to the present invention plane continuous surfaces are those surfaces which limit portions of space, have a longitudinal axis of simmetry and have a poligonal section, perpendicular to said axis of simmetry, with a number n of faces, being n a positive integer number equal or higher than 3, circumference being comprised, which is considered a polygon with an infinite number of faces.

BACKGROUND ART

It is known that flat surfaces having a series of folding lines such as to confer them a general shape like an "accordion", also called waviness hereinbelow, cannot be closed on themselves perpendicularly to the folding lines without distortion.

It has now been found a method of folding which allows said wavy plane surfaces to be closed on themselves and moreover to be angled in different ways in the space without any consequent deformation and/or distortion of the waviness.

SUMMARY OF THE INVENTION

It is an object of present invention to realize a series of foldings on plane surfaces, as said hereinabove, such that a wavy surface can be collapsed on itself perpendicularly to the folding lines without any resulting distorsion.

In order to explain the method of folding according to the invention the following expression "folding line" will be used, meaning a line on a surface along which a folding of the surface is made, the folding being such to locally produce a rising of the surface or alternatively a lowering thereof, with respect to the plane containing the same surface. Therefore, according to the present invention, a plane, closed continuous (or indefinite) surface limiting a portion of space and having a longitudinal axis of simmetry and a poligonal section, perpendicular to said axis of simmetry, with a number n of siides, wherein n is a positive integer number equal or higher than 3, circumference being comprised, in that it is considered a polygon with an infinite number of sides, furtheremore being identified onto said surface a first face, so called inner face or "the back", facing the longitudinal axis of simmetry, and a second face, so called outer face or "the front", opposite to the first one, is folded according the following steps:

(i) making onto said continuous surface closed, primary folding lines, parallel to each other and not necessarily equidistant from each other, lying on planes perpendicular to the longitudinal axis of symmetry of said surface; the number of such folding lines being indefinite and satisfying the following repeating rule: 3+2 m, being m a positive integer equal or higher than zero, said folding lines conferring to the relevant surface a "wavy" shape; such folding lines will be identified, with reference to their number, as even folding lines or odd folding lines;

(ii) linking each odd primary folding line with the subsequent even primary folding line through two further secondary folding lines, having a common origin on the odd primary folding line and diverging from each other, so that the former secondary folding line forms a $\beta$ angle, with $0 \leqq \beta < 90°$ with respect to the perpendicular to the odd and even foldings, and the latter secondary folding line forming a $\Gamma$ angle, with $\beta < \Gamma < 90°$ with respect to the same perpendicular;

(iii) repeating step (ii) specular to the simmetry plane passing through the even folding line;

moreover, the foldings to be obtained along the secondary folding lines of steps (ii) and (iii) will have to generate both a folding facing the longitudinal axis of the surface and a folding facing the opposite direction. The steps (ii) and (iii) can be performed at least once along the whole length of the odd folding line, preferably but not necessarily so that the apexes are all at the same distance among them. Couples of secondary foldings can have either the same or opposite versus, which occurs when there is an even number of apexes. However, the number of repetitions will be function of the desired aestethic effect.

Moreover, it must be said that, according to the present invention, the collapsation of said closed, indefinite surface is obtained without the aid of any kind of cuts or openings on said surface.

Present folding method can be used also with open, finite, flat surfaces.

BRIEF DECRIPTION OF FIGURES

FIG. 1*a* shows a portion of flat surface (1) on which there are placed a series of folding lines (C) and (D), parallel among them, which produce a wavying of said surface (1).

FIG. 1*b* is a cross section view of FIG. 1*a*.

FIG. 1*c* is a perspective view of FIG. 1.

FIG. 2*a*, in a first embodiment of the invention, shows the portion of plane surface (1); the primary lines (C, D, C); the secondary folding lines (G, F), having common origin on the folding line (C) and diverging between them respectively with $\beta=0°$ (not shown) and $\Gamma=45°$, the folding line (F) forming an angle $\alpha=45°$ with the line (D); the further secondary folding lines (G', F'), specular to the previous ones (G) and (F).

FIG. 2*b* schematically shows the angles produced by folding according to FIG. 2*a*.

FIG. 2*c* shows in perspective the results of folding according to FIG. 2*a*.

FIG. 2*d* shows in perspective the results of folding according to FIG. 2*a*.

FIG. 3*a*, in a second embodiment of the invention, shows the portion of plane surface (1); the primary lines (C, D, C); the secondary folding lines (G, F), having common origin on the folding line (C) and diverging between them respectively with $\beta=15°$ and $\Gamma=45°$, the folding line (F) forming an angle $\alpha=45°$ with the line (D); the further secondary folding lines (G', F'), specular to the previous ones (G) and (F).

FIG. 3*b* schematically shows the angles produced by folding according to FIG. 3*a*.

FIG. 3*c* shows in perspective the results of folding according to FIG. 3*a*.

FIG. 3*d* shows in perspective the results of folding according to FIG. 3*a*.

FIG. 4*a*, in a third embodiment of the invention, shows the portion of plane surface (1); the primary lines (C, D, C); the secondary folding lines (G, F), having common origin on the folding line (C) and diverging between them respectively with $\beta=30°$ and $\Gamma=45°$, the folding line (F) forming an angle $\alpha=45°$ with the line (D); the further secondary folding lines (G', F'), specular to the previous ones (G) and (F).

FIG. 4*b* schematically shows the angles produced by folding according to FIG. 4*a*.

FIG. 5*a*, in a fourth embodiment of the invention, shows the portion of lane surface (1); the primary lines (C, D, C);

the secondary folding lines (G, F), having common origin on the folding line (C) and diverging between them respectively with $\beta=37.5°$ and $\Gamma=45°$, the folding line (F) forming an angle $\alpha=45°$ with the line (D); the further secondary folding lines (G', F'), specular to the previous ones (G) and (F).

FIG. 5*b* schematically shows the angles produced by folding according to FIG. 5*a*.

FIG. 6*a*, in a fifth embodiment of the invention, shows a development of the folding of previous figures, folding lines (G, F, G', F') being simmetrically doubled and producing the following angles $\beta=30°$, $\Gamma=60°$, $\alpha=30°$.

FIG. 6*b* schematically shows the angles produced by folding according to FIG. 6*a*.

FIG. 6*c* shows in perspective the results of folding according to FIG. 6*a*.

FIG. 6*d* shows in perspective the results of folding according to FIG. 6*a*.

FIG. 6'*a*, in a sixth embodiment of the invention, shows the same folding system of FIG. 6*a*, with the following angles $\beta=20°$, $\Gamma=\alpha=45°$.

FIG. 6'*b* shows in perspective a container folded according to the folding system of FIG. 6'*a*.

FIG. 6'*c* is a section view of the FIG. 6'*b* container.

FIG. 6'*d* shows the planar development of the FIG. 6'*b* container.

FIG. 7*a*, in a seventh embodiment of the invention, shows the same folding of FIG. 2*a*, repeated according to specific symmetry planes.

FIG. 7*b* shows in perspective what obtained by folding according to FIG. 7*a*.

FIG. 8*a*, in a eighth embodiment of the invention, shows in perspective what obtained by folding according to FIG. 7*a*.

FIG. 8*b* shows in perspective the results of folding according to FIG. 7*a*.

FIG. 9*a*, in a nineth embodiment of the invention, shows a development of the folding of the previous figures, folding lines (G, F, G', F') being simmetrically doubled ("in symmetry") and producing the following angles $\beta=22°$, $\Gamma=\alpha=45°$.

FIG. 9*b* shows in perspective the results of folding according to FIG. 9*a*.

FIG. 9*c* shows in perspective the results of folding according to FIG. 9*a*.

FIG. 10*a*, in a tenth embodiment of the invention, shows a particular repetition of folding lines of FIG. 9*a*.

FIG. 10*b* shows in plan view the results of folding according to FIG. 10*a*.

FIG. 10*c* shows in perspective the results of folding according to FIG. 10*a*.

FIG. 11*a* shows the same folding of previous FIG. 4*a*, folding lines (G, F, G', F') being simmetrically doubled "in progression". FIG. 11*b* shows in perspective the results of folding according to FIG. 11*a*.

FIG. 11*c* shows in perspective the results of folding according to FIG. 11*a*.

FIG. 11*d* is a development of the folding of FIG. 11*a* along a circumference, in plane view.

FIG. 11*e* is a development of the folding of FIG. 11*a* along a circumference, in perspective.

FIG. 11*f* shows a bottle obtained by using the folding system of FIG. 11*a*.

FIG. 12*a* shows a particular repetition of the folding according to FIG. 11*a*.

FIG. 12*b* shows in perspective the results of folding according to FIG. 12*a*.

FIG. 12*c* shows in perspective the results of folding according to FIG. 12*a*.

FIG. 12*d* is a development of the folding of FIG. 12*a* along a circumference, in plane view.

FIG. 13 shows in perspective a development of the folding of FIG. 7*a*.

FIG. 14*a* shows a particular application in accordance with FIG. 11*a*, wherein the folding lines are replaced by rigid segments.

FIG. 14*b* schematically shows the angles produced according to FIG. 14*a*.

FIG. 14*c* shows in perspective the results of folding according to FIG. 14*a*.

FIG. 15*a* shows a particular repetition of the structure of FIG. 14*a*.

FIG. 15*b* schematically shows the structure of FIG. 15*a* angled.

FIG. 16 shows in perspective the structure of FIG. 15*a* angled.

FIG. 17*a* shows a particular application of FIG. 10*a*.

FIG. 17*b* shows a particular application of FIG. 10*b*.

FIG. 17*c* shows a particular application of FIG. 10*c*.

Figure 9A:
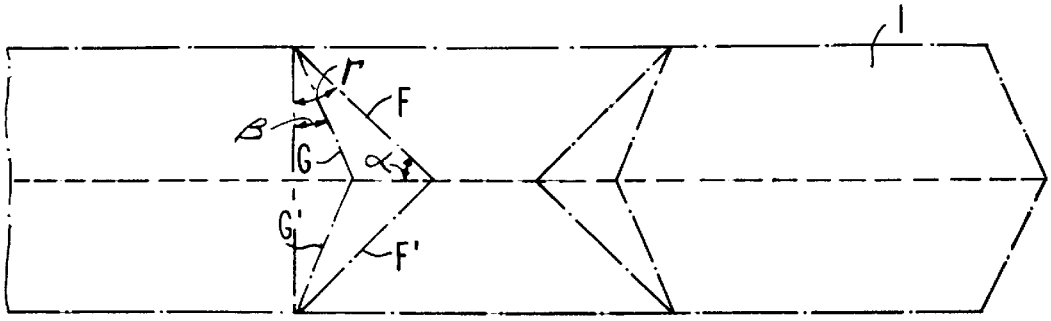
Figure 20A:
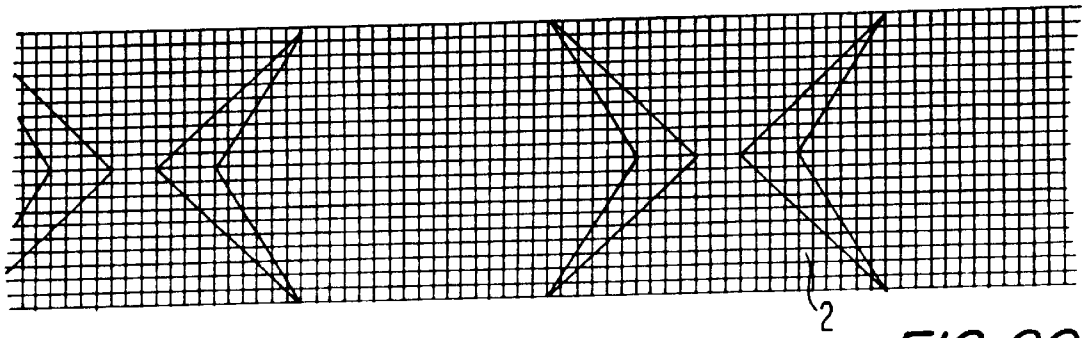

FIG. 20*a* shows a particular application of FIG. 9*a*.

Figure 9B:
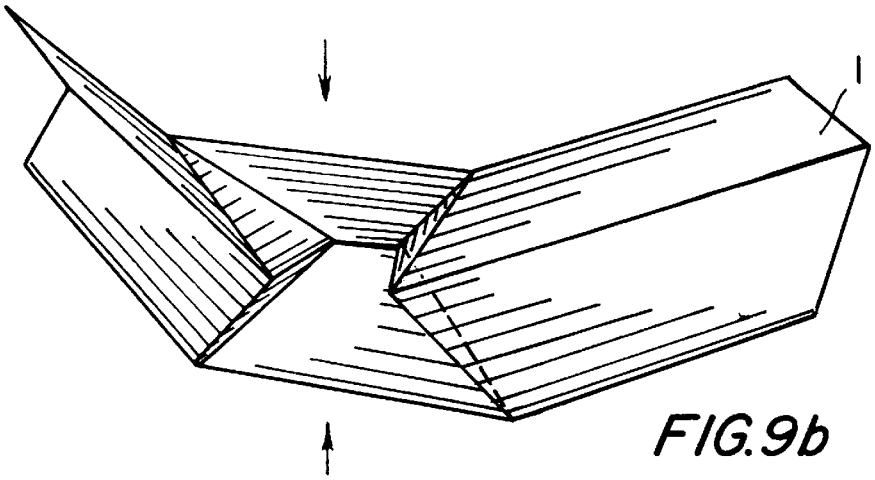
Figure 9C:
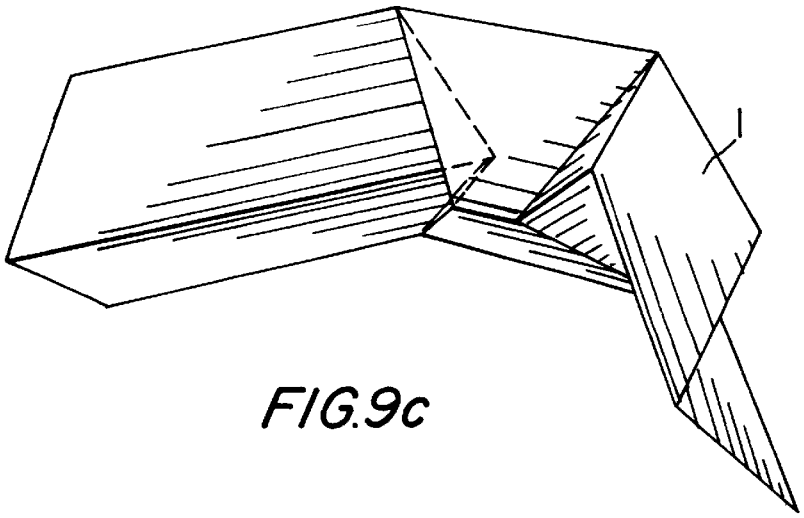
Figure 20B:
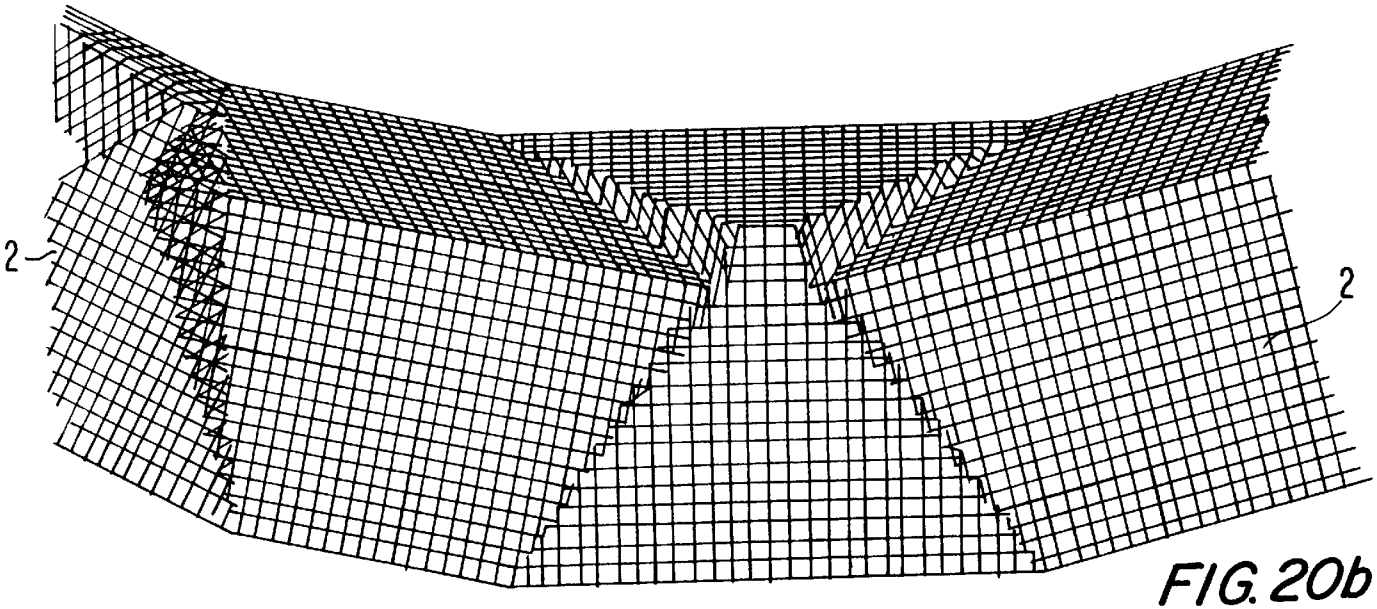

FIG. 20*b* shows a particular application of FIG. 9*c*.

DETAILED DESCRIPTION OF THE INVENTION

Features and advantages of the containers according to the invention will be illustrated with reference to the enclosed drawings, in which some embodiments of the present invention are shown as exemplificatory not limiting examples.

Figure 1A:
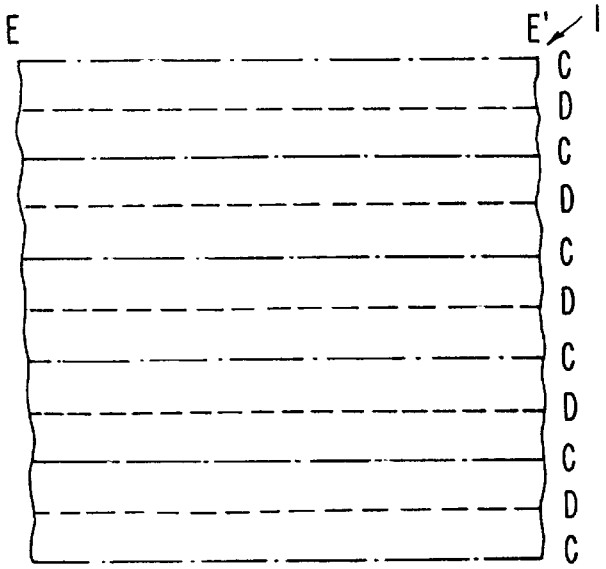
Figure 1B:
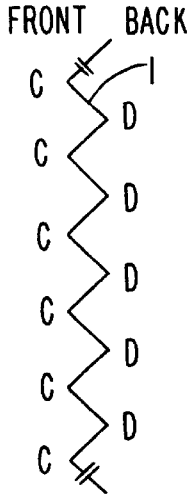
Figure 1C:
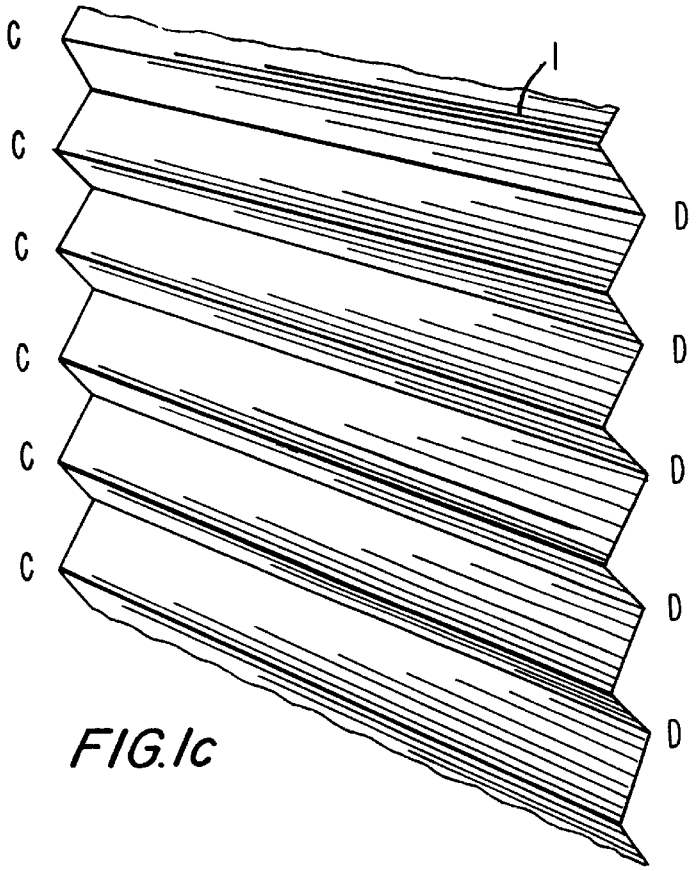

In the drawings, for convenience and clarity, the folding method according to the invention will be shown on plane portions of surfaces. Moreover, in all the drawings the folding lines defining, with respect to an observer, a crest rising from the surface, will be identified with broken-dotted lines, whereas the ones defining a depression will be identified with broken lines. In any case it is within the scope of the invention to provide folding directions opposite to the ones previously described. In FIG. 1*a* it is shown a portion of flat surface (1) on which with letters (C) and (D) there are identified parallel primary folding lines capable to generate the wavy structure shown in section in FIG. 1*b* and in perspective in FIG. 1*c*. With particular reference to FIG. 1*a*, the primary folding lines which produce a crest rising from the plane surface towards an observer, will be identified with letter (C) (broken-dotted lines), whilst the primary folding lines producing a depression will be identified with letter (D), (broken lines). As above explained, a direction of folding opposite to the one previously described is comprised within the scope of the present invention. As obvious, it is impossible to close the surface of FIG. 1*a* along lines (E, E'), unless deforming the folding lines (C) and (D).

FIGS. 2*a* to 6'*a* show the folding method according to the invention applied onto a portion of plane surface (1). According to the above method, starting from a series of (in this case three) primary folding lines parallel to each other (C, D, C), the folding line (C) will be linked to the folding line (D) through two further secondary folding lines (G, F), having the same origin on the folding line (C) and diverging between them with angles β and Γ, as described in the above and, afterwards, through two additional secondary folding lines (G', F'), corresponding to the previous (G) and (F) and specular with respect to the simmetry plane passing through the folding line (D) when folding lines (C) and (D) are parallel.

Figure 2A:
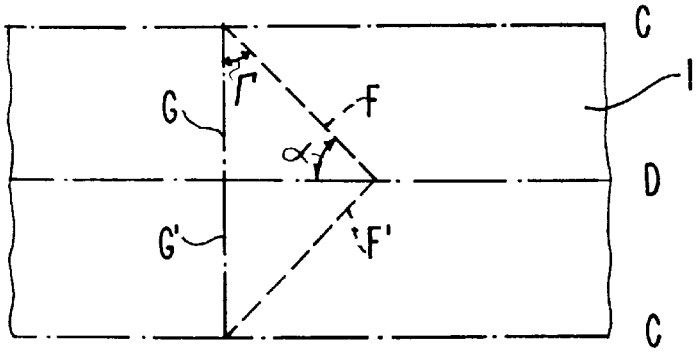
Figure 2B:
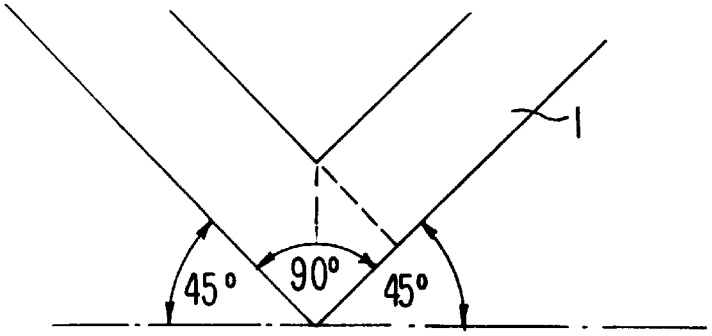

Particularly FIG. 2*a* shows the portion of plane surface (1), primary folding lines (C, D, C), the folding line (C) being linked to the subsequent folding line (D) by means of the further secondary folding lines (G, F), having common origin on the folding line (C) and diverging, respectively, by β=0° (not shown) and Γ=45°, the folding line (F) forming an angle α=45° with the line (D). The secondary folding lines (G', F') are specular to the previous ones (G) and (F) with respect to the simmetry plane passing through the folding line (D). FIG. 2*b* shows, in top view, the folding angles obtained by folding according to FIG. 2*a*.

Figure 2C:
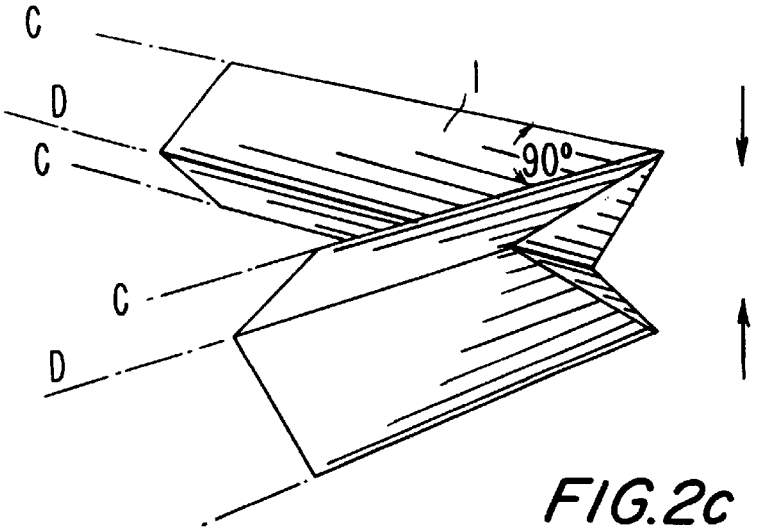
Figure 2D:
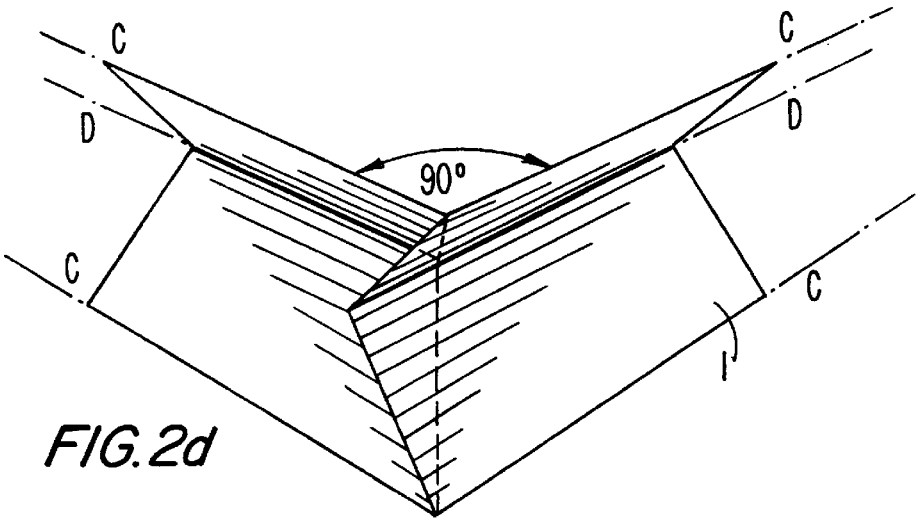

With the folding operation according to the folding lines of FIG. 2*a* it is obtained what is shown in perspective in FIGS. 2*c* and 2*d*. As can be seen, it is thus possible to operate a compression on the surface (1), as indicated by the double arrow in FIG. 2*c*. In this case, as illustrated in FIGS. 2*b* and 2*d*, the surface (1) is folded along an angle of 2*a*, that is 90°.

Figure 3A:
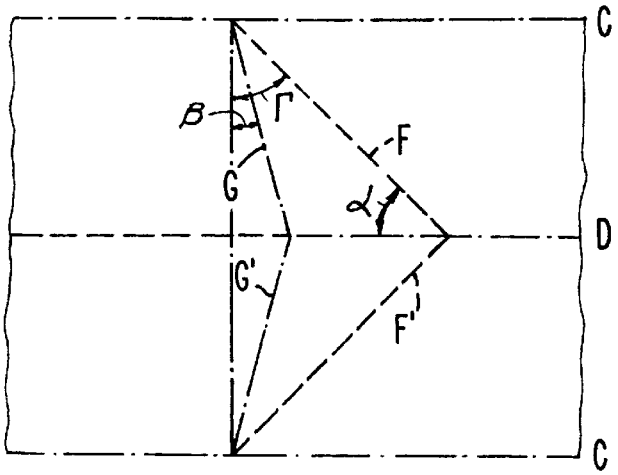
Figure 3B:
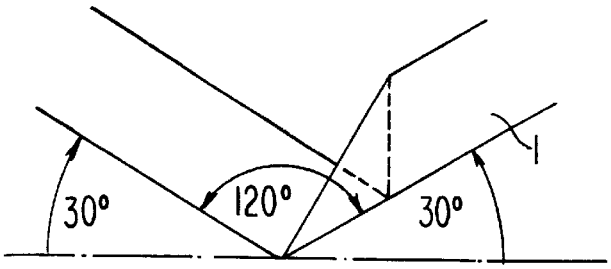

FIG. 3*a* shows the portion of plane surface (1), the primary folding lines (C, D, C), the folding line (C) being linked to the subsequent line (D) by means of the secondary folding lines (G, F), having common origin on the folding line (C) and diverging respectively by β=15° and Γ=45°, the folding line (F) forming an angle α=45° with the line (D). The further folding lines (G', F') specular to the previous ones (G) and (F) with respect to the simmetry plane passing through the folding line (D). FIG. 3*b* shows, in top view, the folding angles obtained by folding according to FIG. 3*a*.

Figure 3C:
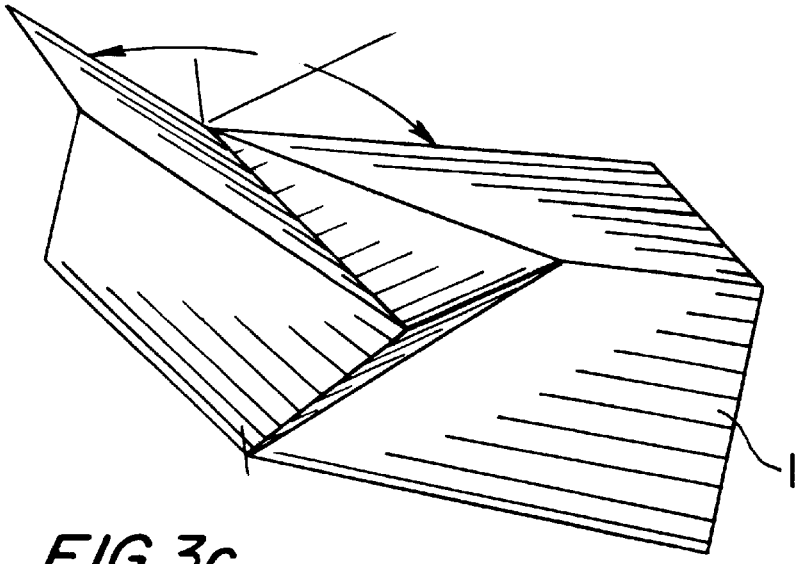
Figure 3D:
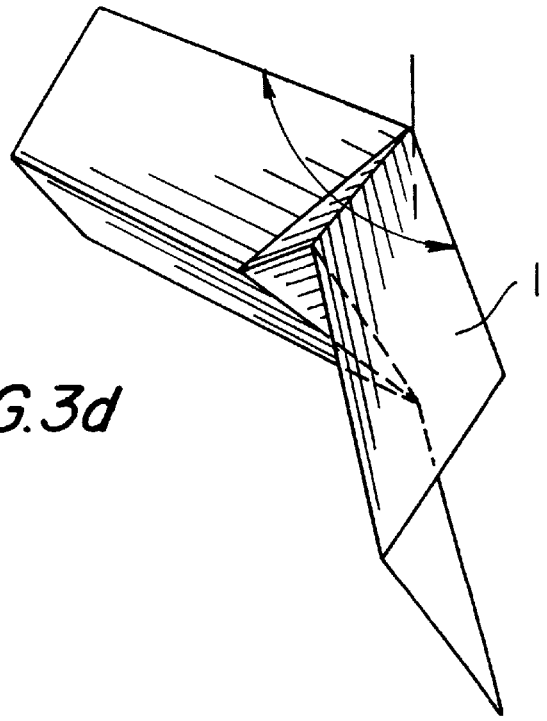

The above is shown in perspective in FIGS. 3*c* and 3*d*. In this case, as illustrated in FIGS. 3*b*, the surface (1) is folded with an angle of 2(α+β)=120°.

Figure 4A:
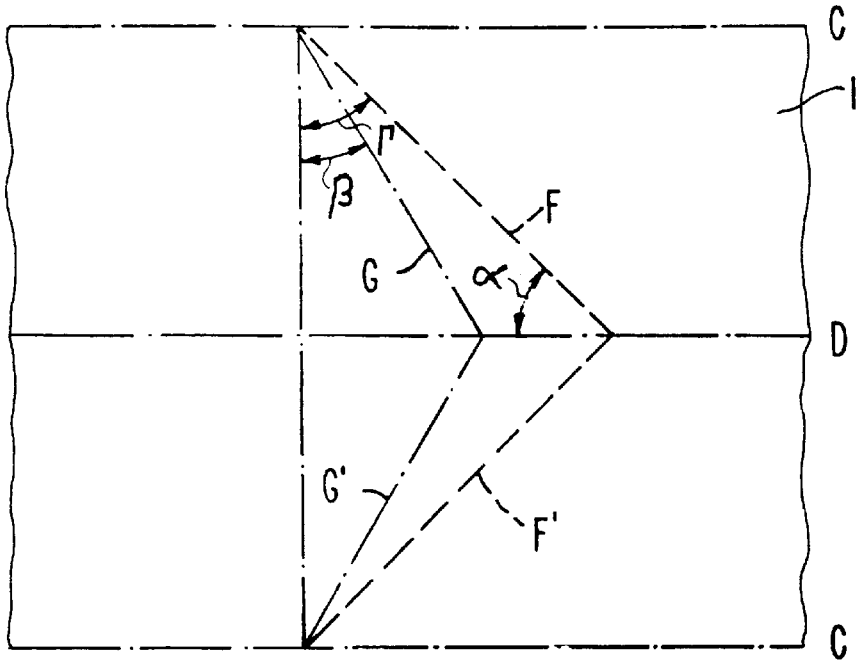
Figure 4B:
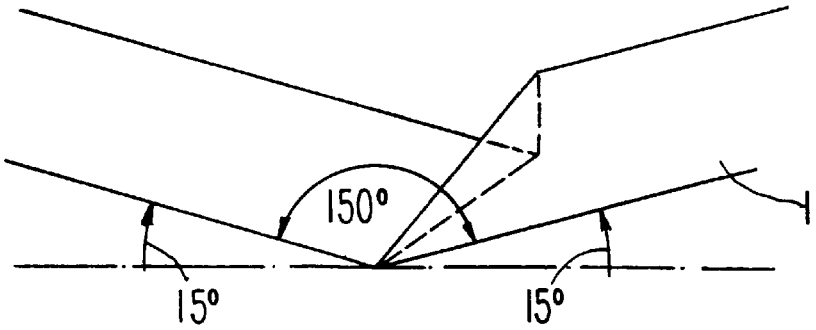
Figure 5A:
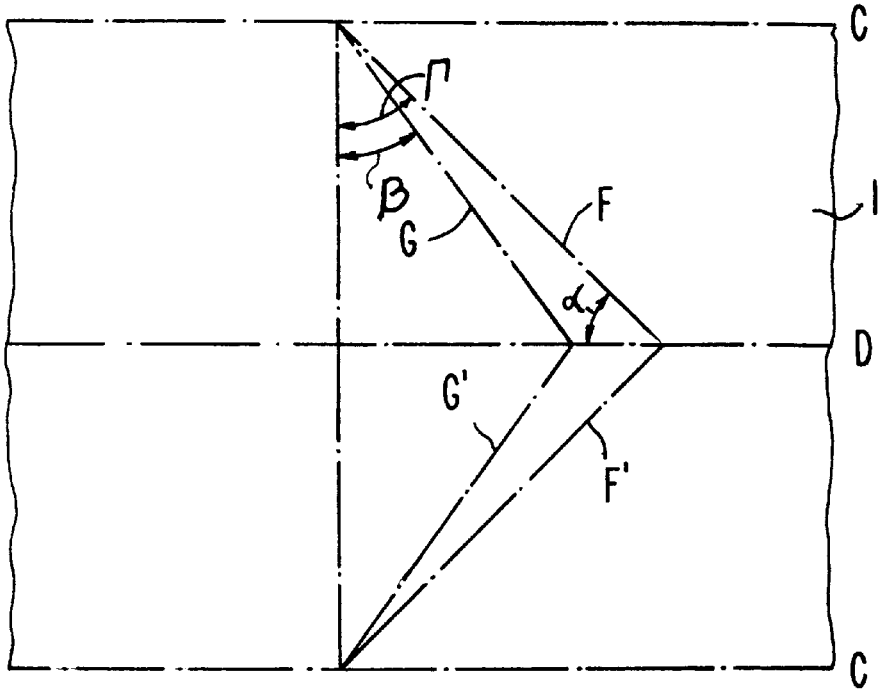

As previously described in FIGS. 3*a* to 3*d* for the folding angle 2(α+β)=120°, FIGS. 4*a*, 4*b* and 5*a*, 5*b* illustrate two further examples of folding, respectively with angles β=30° and Γ=45° in FIG. 4*a* and β=37.5° and Γ=45° in FIG. 5*a*, in both cases being α=45°.

Figure 5B:
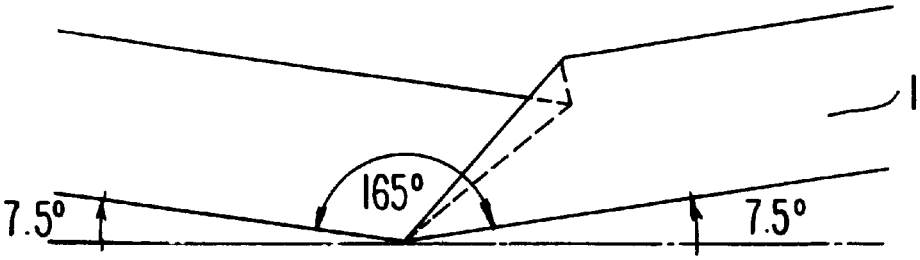

FIGS. 4*b* and 5*b* illustrate in top view, the folding angles produced by the folding operation according to FIGS. 4*a* and 5*a*, respectively. Also in this two cases the surface (1) is folded with an angle of 2(α+β), that is respectively 150° and 165°.

FIG. 6*a* shows a particular development of what is illustrated in FIG. 4*a*. In this case the secondary lines (G, F, G', F') are doubled with respect to a simmetry plane passing through the origin of said secondary folding lines. The folded surface shows angles of β=30°, Γ=60° and α=30°.

FIG. 6'*a* shows the same folding system as in FIG. 6*a*; in this case with the following angles β=20°, Γ=α=45°.

As shown in FIG. 6*b*, the surface (1) is folded with an angle of 60°. In this case, like all the cases in which α<45°. The folded part comprised between folding lines (G, G', F, F') protrudes out of the folded surface. In order avoid it, it is preferred to make a further folding along line HH', joining the intersection points of lines (G, G') on line (D). The outcome of the folding operation is shown in FIGS. 6*c* and 6*d*.

When such folding is made with angles β=20°, Γ=α=45° (according to FIG. 6'*a*) and is applied four times on a surface, a container can be obtained, as shown in FIG. 6'*b* in perspective. Such container can be advantageously a container for liquids which, when empty, can be flattened. FIG. 6'*c* is a section view of the FIG. 6'*b* container, obtained along the simmetry plane parallel to the P surfaces of the container, such surfaces being rectangular.

The planar development of the FIG. 6'*b* container is shown in FIG. 6'*d*, wherein folding lines according to FIG. 6'*a* are drawn up. During the folding, the hatched portions of surface overlap to each other.

Figure 7A:
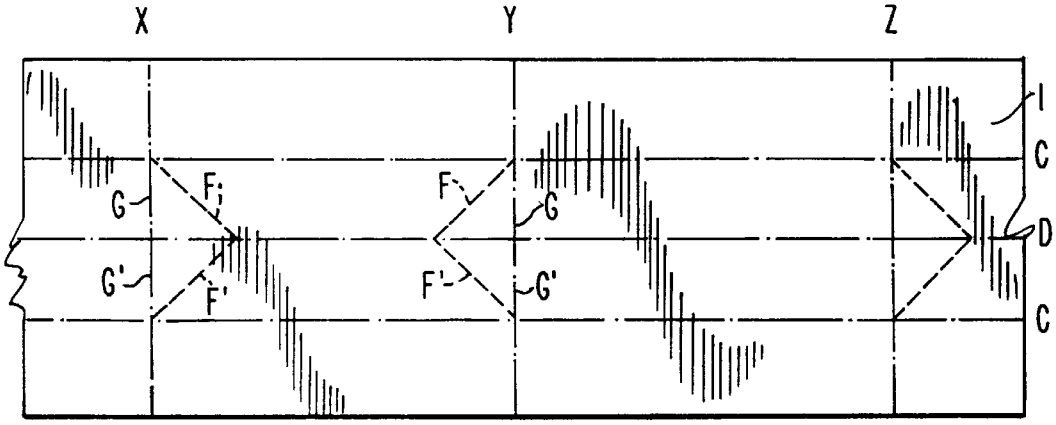

FIG. 7*a* shows a development of the embodiment illustrated in FIGS. 2*a* to 2*d*. That is, with reference to FIG. 2*a*, the series of folding lines (G, F, G', F') is repeated with respect to simmetry planes perpendicular both to the surface (1) and to the lines (C, D, C). In FIG. 7*a* there is also indicated the folding lines (X, Y, Z) passing through (G, G').

Figure 7B:
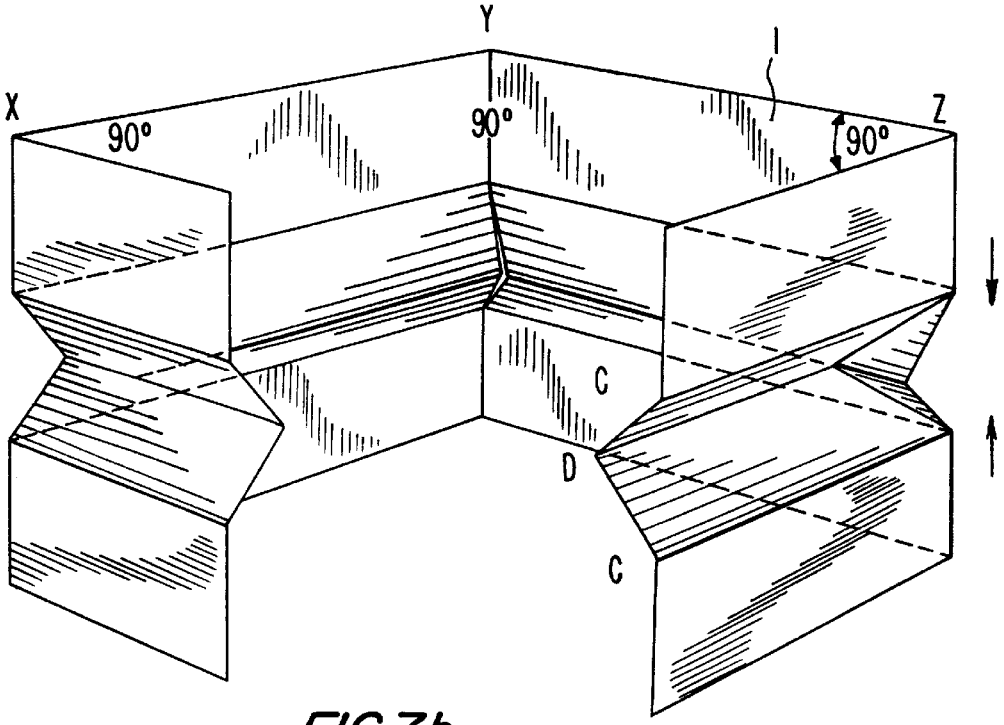

The object partially shown in perspective in FIG. 7*b* is obtained by folding along the folding lines of FIG. 7*a*. As can be seen, it is possible to operate a compression on the surface (1), as indicated by the arrows. In this case only three angles of 90° are shown.

Figure 8A:
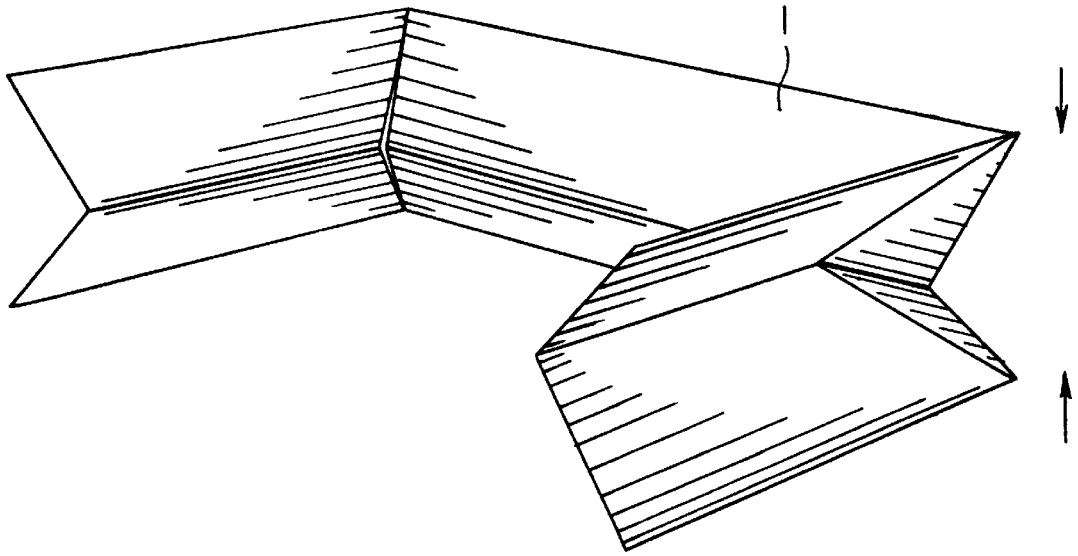
Figure 8B:
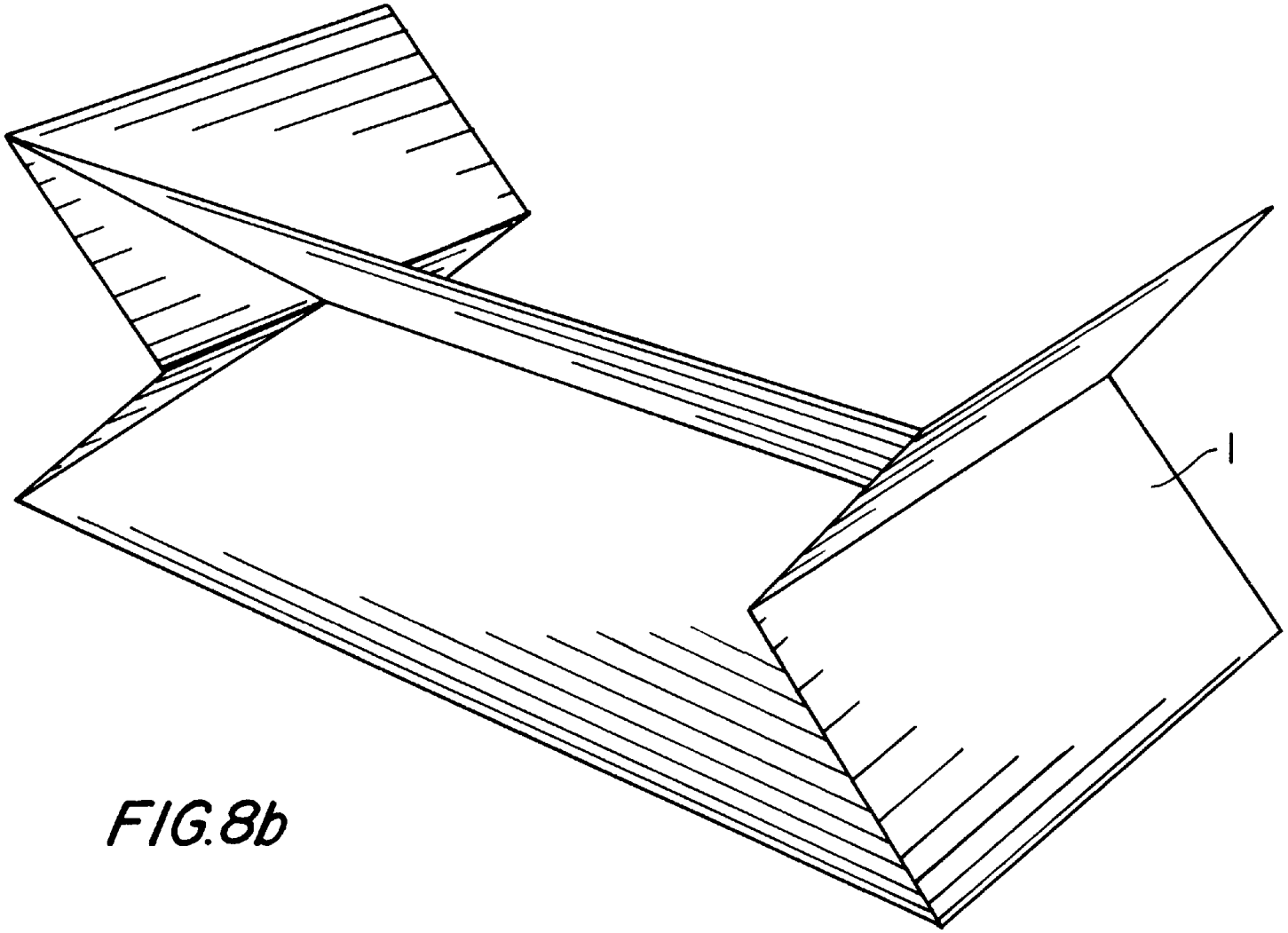

FIGS. 8*a* and 8*b* are perspective views of a particular development of FIGS. 7*a* and 7*b*. That is, with reference to FIG. 7*a*, in this case the series of secondary folding lines (G, F, G', F') is repeated only twice. In this case, the surface (1) is folded with two angles of 90°.

FIG. 9*a* shows a particular repetition (called "in simmetry") of the series of secondary folding lines (G, F, G', F') with respect to a simmetry plane perpendicular both to the surface (1) and to the lines (C, D, C). In this case the angles are β=22° and Γ=α=45°. The object shown in FIG. 9*b* (front perspective) and FIG. 9*c* (back perspective) is obtained making a folding along the folding lines of FIG. 9*a*. As can be seen in FIG. 9*b*, it is possible to operate a compression on the surface (1), as indicated by the arrows.

Figure 10A:
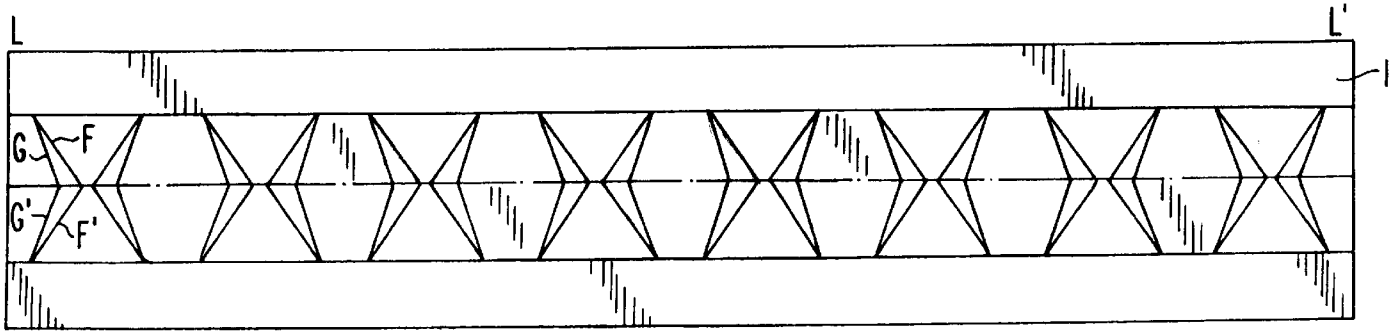
Figure 10B:
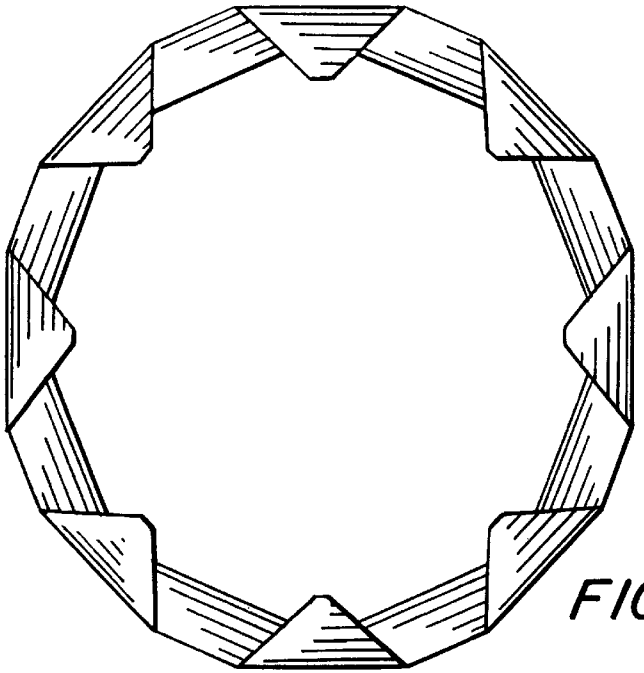
Figure 10C:
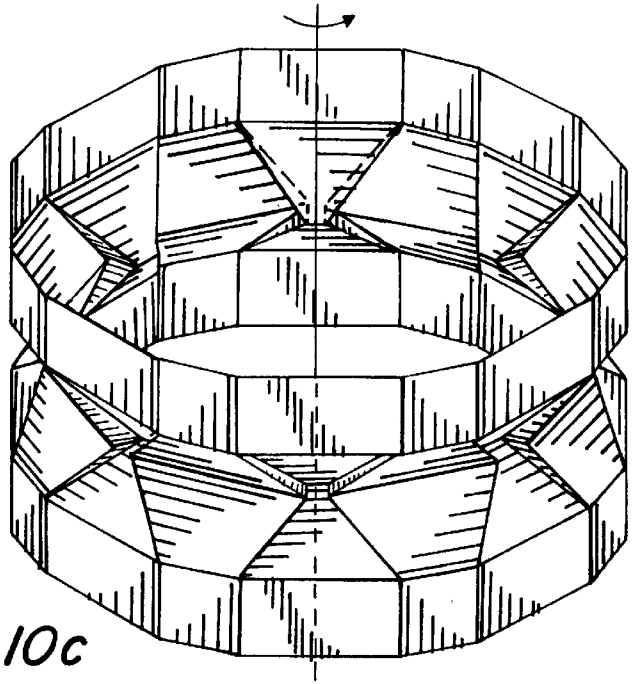

In FIG. 10 it is shown a particular and ordered repetition of the series of folding lines of FIG. 9*a*. Such ordered repetition of lines generates the complex of folding lines illustrated in the above mentioned FIG. 10*a*. By operating a folding along the folding lines of FIG. 10*a* and by joining the ends LL' a closed surface is obtained, folded as illustrated in FIG. 10*b* in plan view and in FIG. 10*c* in perspective.

Figure 11A:
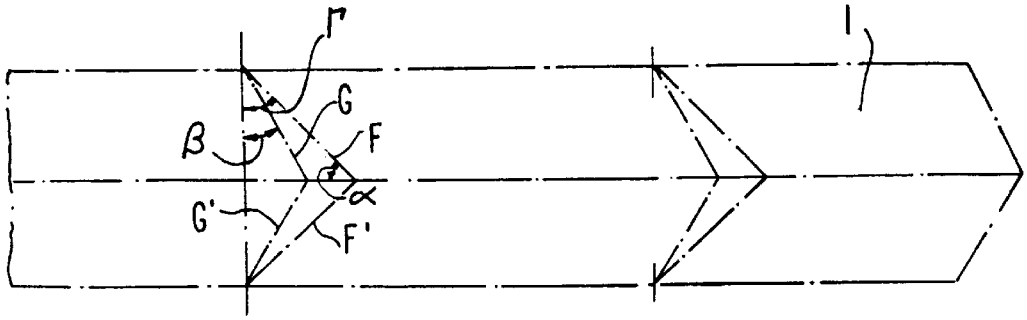
Figure 11B:
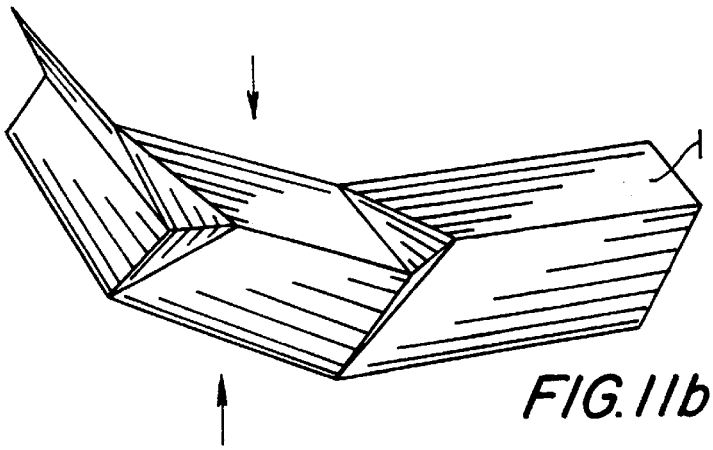

FIG. 11*a* shows a particular repetition (called "in progression") of the series of secodary folding lines (G, F, G', F'). In this case the angles are β=30° and Γ=α=45°. The object of FIG. 11*a* in front perspective (external) and in FIG. 11*b* in back perspective (internal) can be obtained by folding along the folding lines of FIG. 11*a*. As can be seen in FIG. 11*b*, it is possible to operate a compression on the surface (1), as indicated by the arrows.

Figure 11C:
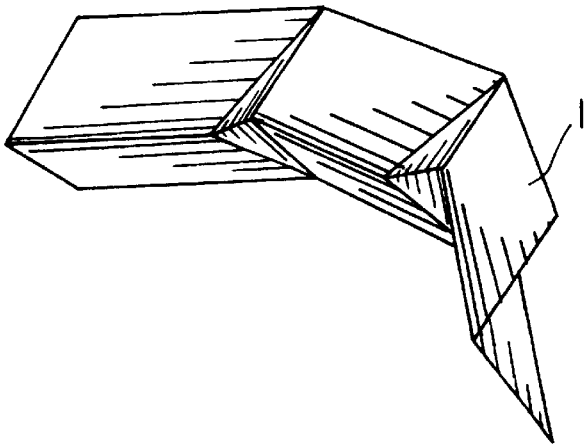
Figure 11E:
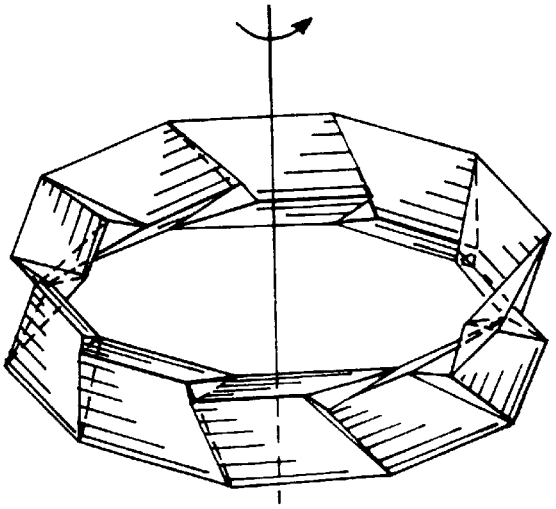
Figure 11D:
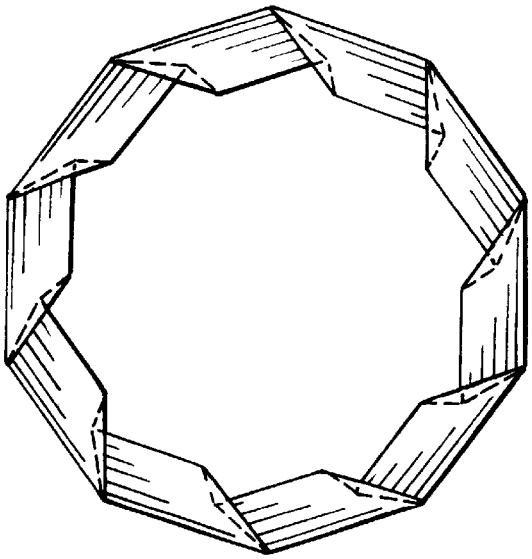
Figure 11F:
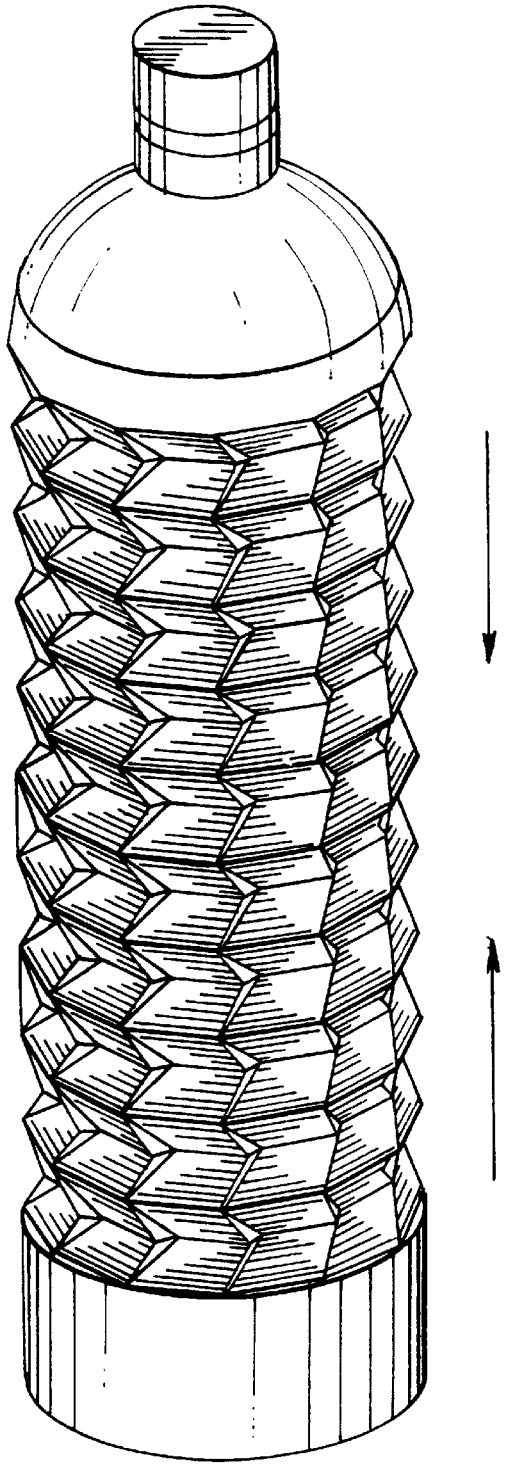

FIGS. 11*d* and 11*e* constitute a development of the folding lines of FIGS. 11*b* and 11*c* along a circumference. An application of said foldings for a plurality of circumferences, continuously superimposed one onto the other, can lead to the realisation of an object, such the bottle illustrated in FIG. 11*f*. It is possible to operate a compression on the surface (1), as indicated by the arrows.

Figure 12B:
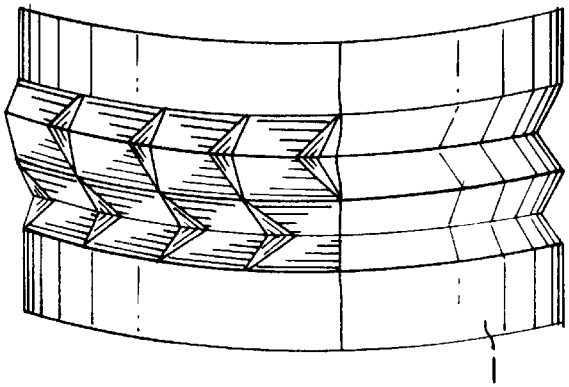
Figure 12C:
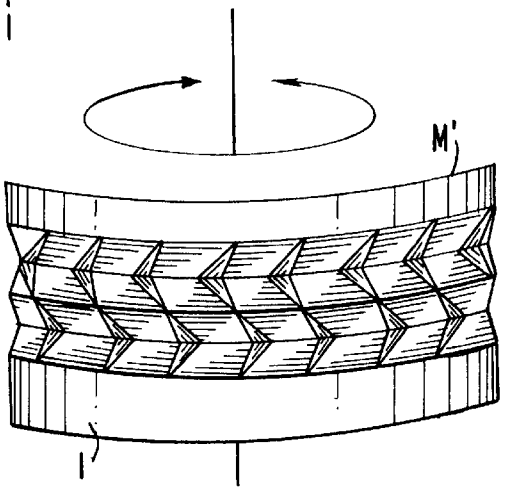
Figure 12A:
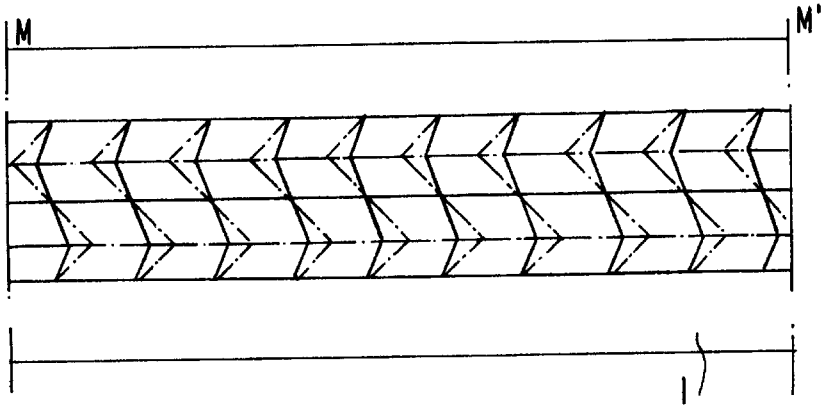

With reference to FIGS. 12*a* to 12*c*, it is illustrated a particular repetition of the series of folding lines of FIG. 11*a*. Such ordered repetition in line according two ways, opposite one another, generates the complex of folding lines illustrated in FIG. 11*a*. By operating a folding along the folding lines of FIG. 12*a* and joining the ends M and M', the curved and folded surface can be obtained, as shown in FIGS. 12*b* and 12*c*. As can be seen in FIG. 12*c*, it is possible to operate a compression on the surface (1), as indicated by the arrows.

Figure 12D:
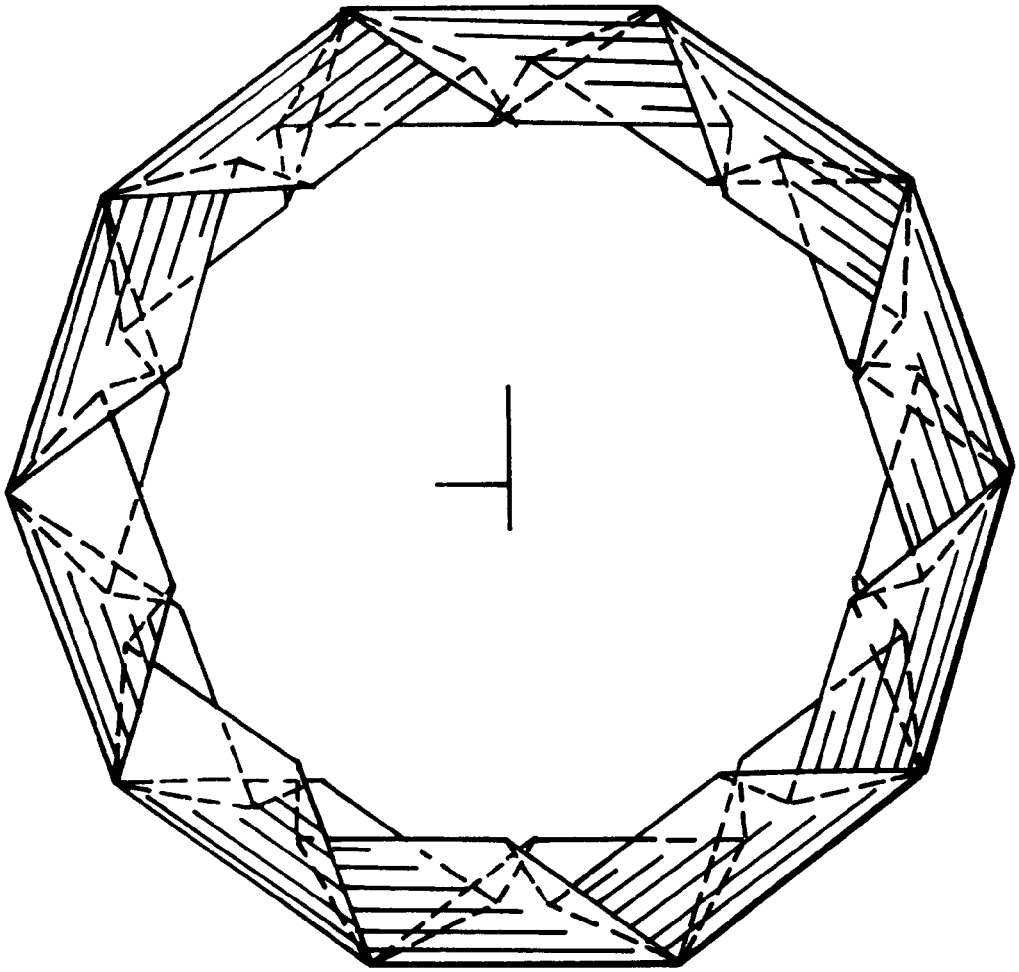

FIG. 12*d* is a plan view of the views of FIGS. 12*b* and 12*c*, when the ends M and M' have been joined.

Figure 13:
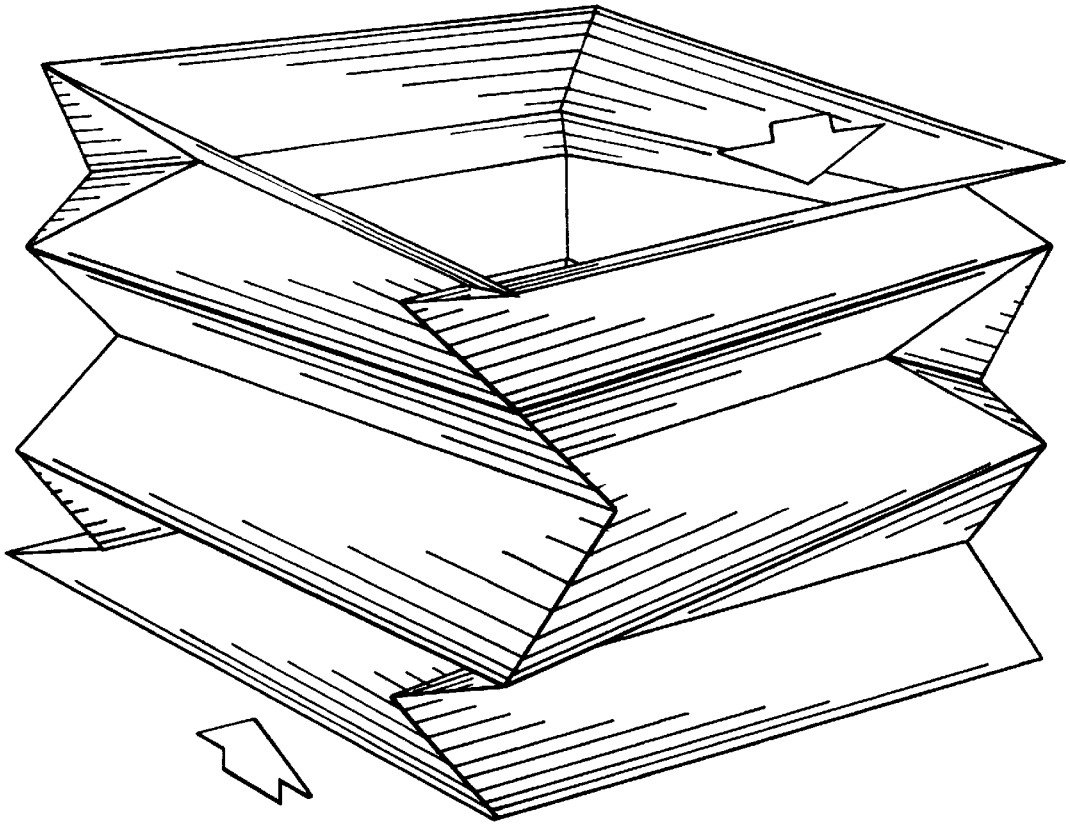

FIG. 13 shows a particular development of what is illustrated in FIGS. 7*a* and 7*b*. That is, with reference to FIG. 7*b*, in this case the structure in completely closed and thus it has four angles of 90°. The perspective view of FIG. 13 illustrates the possibility of the structure obtained by folding the surface (1) according to the invention of being compressible in any position along the perimeter of each side, as shown by the arrows. This demonstrates the flexibility of the structure.

As can be seen from the FIGS. 2*a* to 13, it is possible to utilize an infinite number of angles between secondary folding lines (G) and (F) and primary parallel lines (C, D, C), all within the scope of the present invention.

The folding system according to the invention strengthens those surfaces made of materials with low rigidity and low thickness, moreover permits the surfaces to assume an infinite number of shapes, and at the same time to confer them an increased strength together with resilience and flexibility. Therefore the folding method confers to the surfaces a structural rigidity which otherwise they would not posses, combined with an adequate resilience and a flexibility without limits of shape and dimensions, thus permitting at the same time a volume reduction, due to the compression operable onto the foldings.

The above method permits to compress the objects according to present invention, when it is necessary a reduction of their volume, such as in the case of packaging and tranport.

The above folding lines can be realized at any step of the production of the objects, in function of the requirements of production.

Suitable materials are: paper, cardboard, plastic paper as for tetrapack, leather, polycarbonates, any kind of plastics, such as plexiglass, cellophane, polyethylene and the like, gums, metallic sheets and carbon fibres.

By using the folding method described in the invention, surfaces can be obtained, which can be used for making:

any kind of containers, for solids and for liquids, which need a reduction of volume or capacity (advantageous is the application in food industry, particularly under vacuum storage); moreover, envelops, suitcases, baskets, boxes;

conduits, pipes and ducts which need flexibility and resilience without limitation of section or length.

Moreover the folding method according to the invention can be applied to non-continuous plane, open surfaces; this is the case, for instance, of architectonic structures for covering swimming-pools and sports plants. In addition, the method allows an unlimited repetitiveness, due to its modular structure.

Fields of application are: aerospace, naval, motor, railroad and military fields.

A particular application of the folding method of the invention is the one in which each folding line is replaced by a rigid linear element, e. g. tubular element, made of any kind of rigid material (metal, plastics, wood, etc.), hinged to each other.

In this manner there is only a sort of truss structure. The thus obtained structures are characterized by increased strength, therefore they can be used as functional and architectonic structures of large dimensions, which however can be compressed along the folding lines in order to achieve a reduced size.

The above particular application, based on the use of rigid segments, is shown in an exemplificatory, non limiting way, in FIGS. 14*a* to 19. In such figures the connection points of the rigid elements are identified by small circles.

Figures 14A, 14B, 14C:
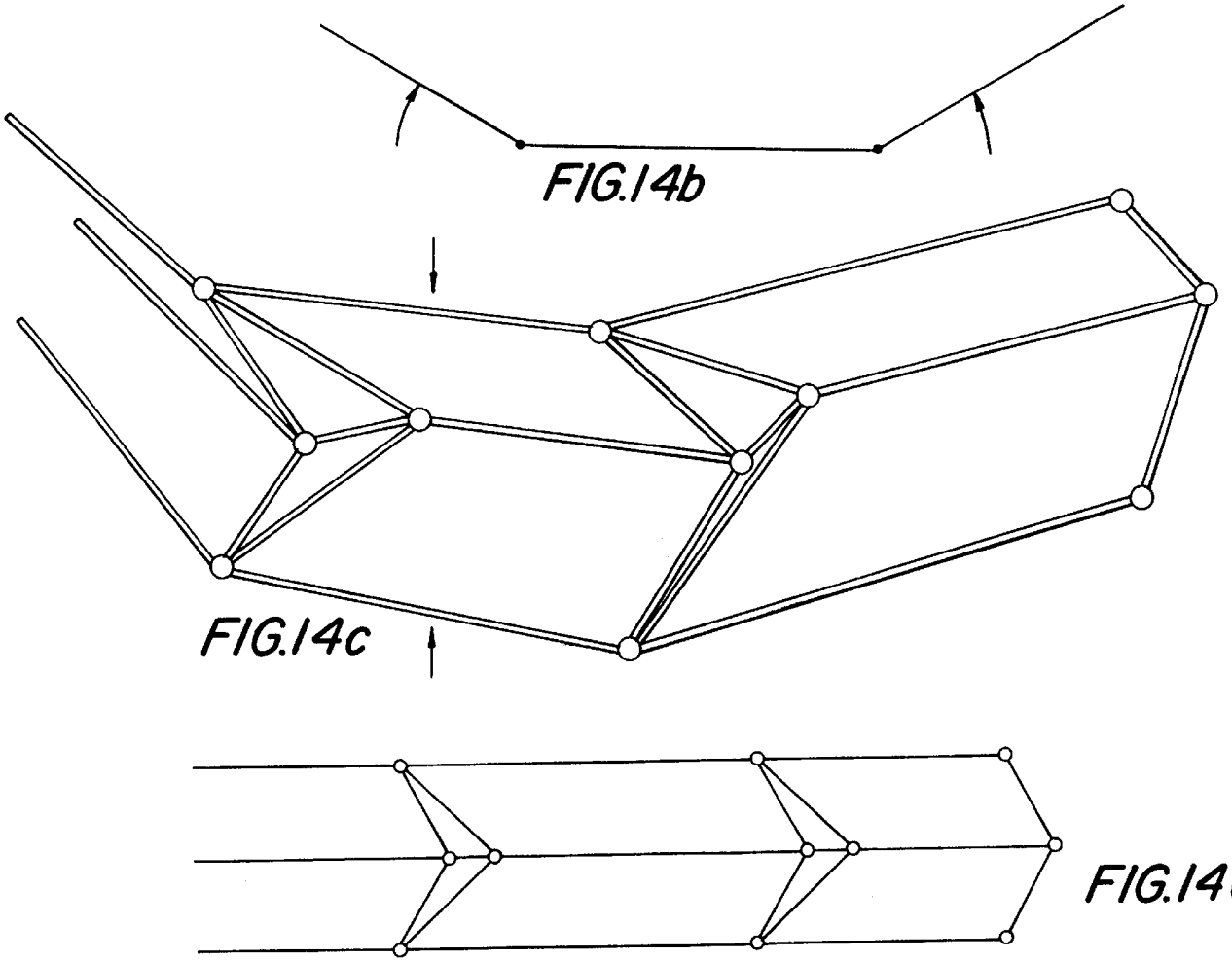

As can be seen in FIG. 14*a*, this is a particular application in accordance to FIG. 14*a*, wherein all the folding lines have been replaced by linear rigid elements. The structure in FIG. 14*a*, folded as schematically shown in FIG. 14*b*, is illustrated in FIG. 14*c* in perspective. As can be seen in said FIG. 14*c*, it is possible to operate a compression of the structure, as indicated by the arrows.

Figure 15B:
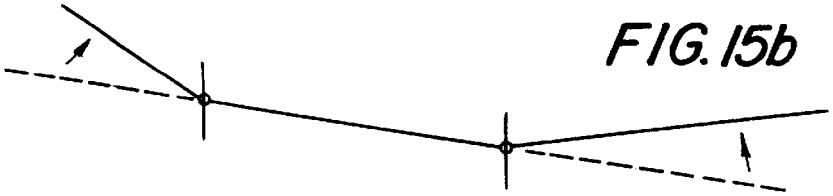
Figure 15A:
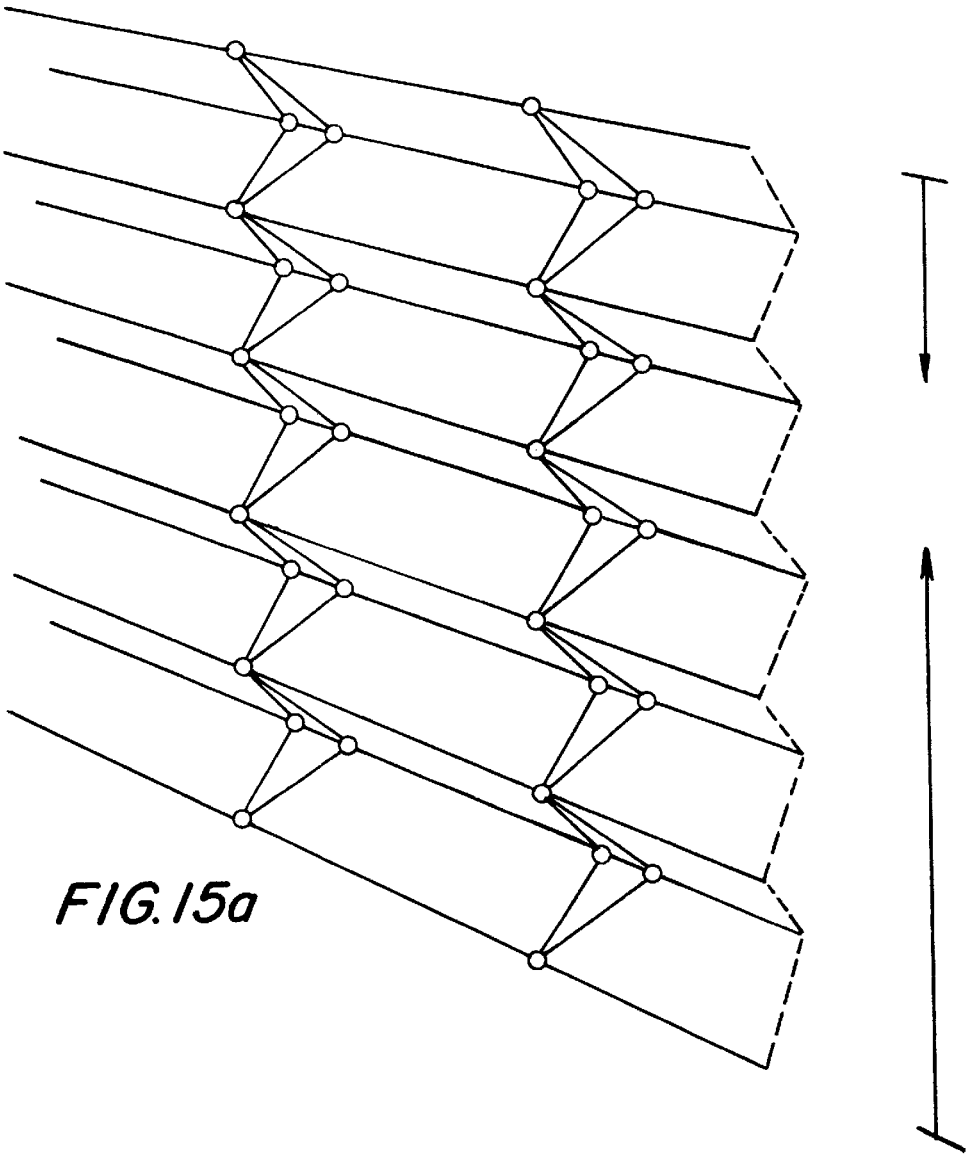

FIG. 15*a* is a repetition of the structure illustrated in FIG. 14*a*. FIG. 15*b* shows schematically a way of angling the structure illustrated in FIG. 15*a*.

Figure 16:
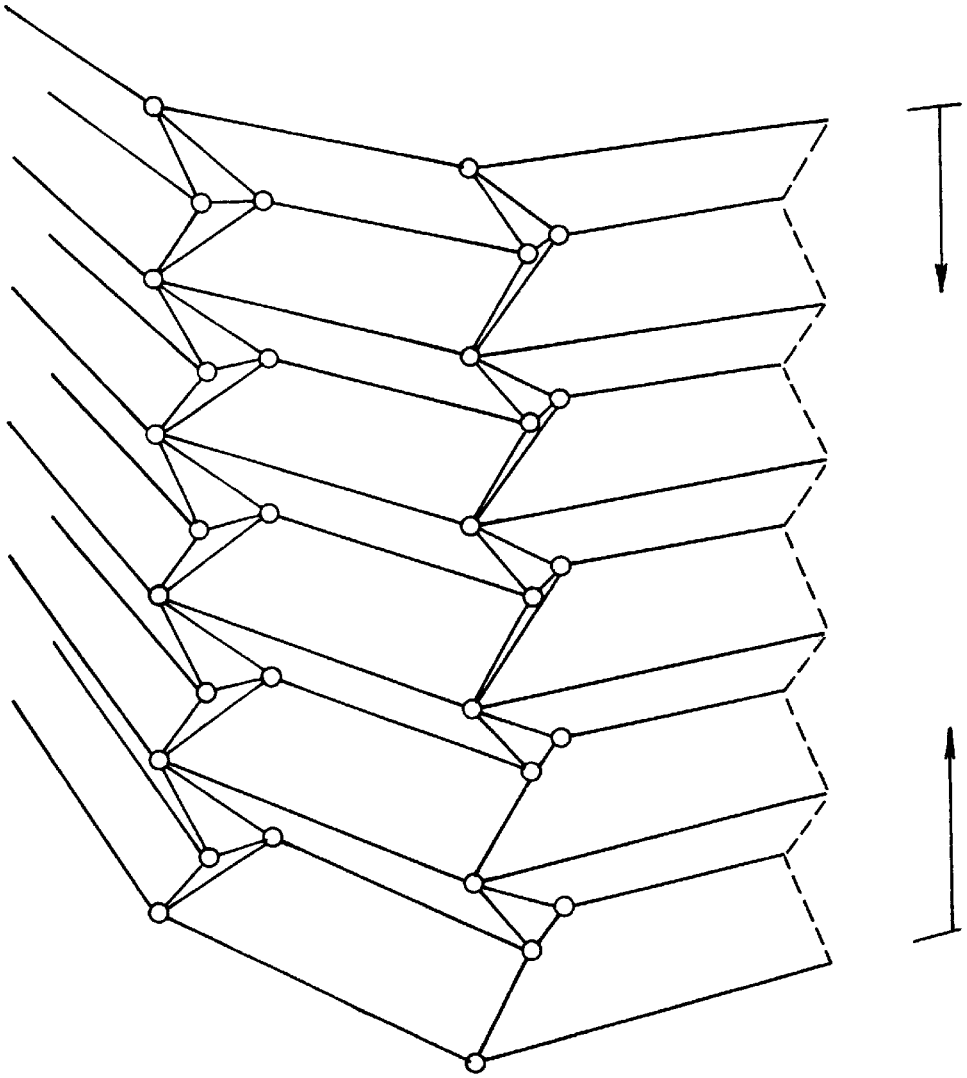

FIG. 16 is a perspective view of the structure of FIG. 15, angled as schematically shown in FIG. 15*b*. As can be seen in FIG. 16, it is possible to operate a compression of the structure, as indicated by the arrows.

Figure 17A:
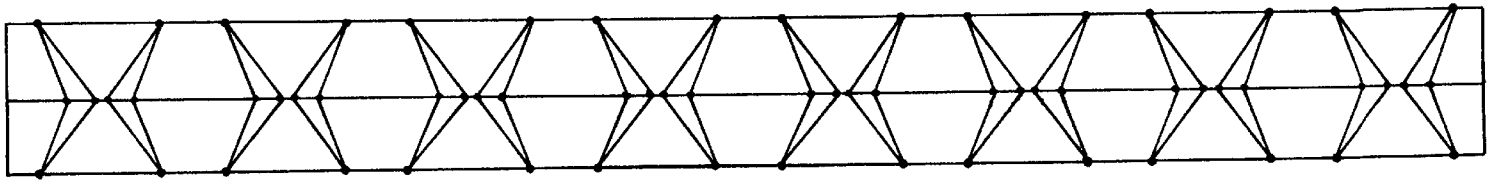
Figure 17C:
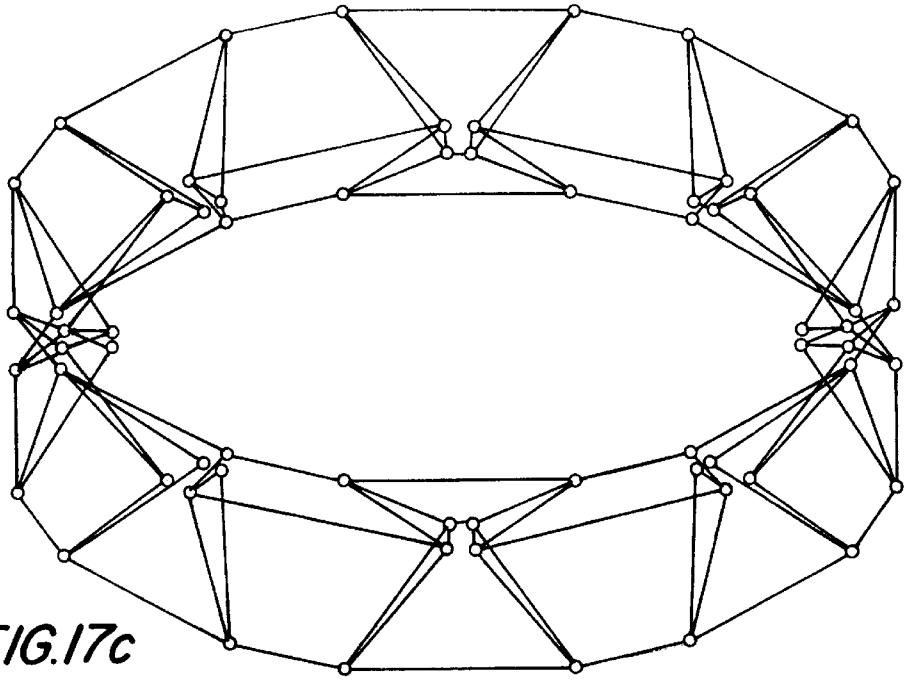
Figure 17B:
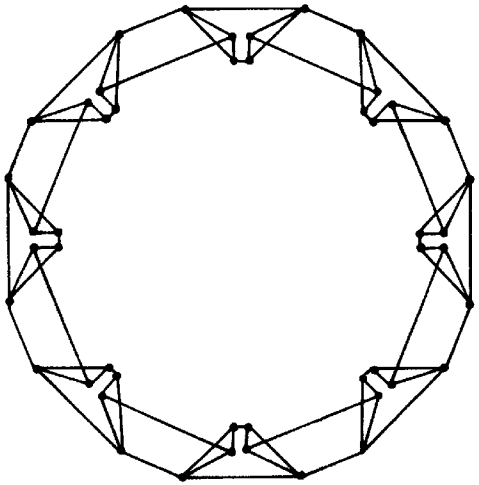

FIGS. 17*a*, 17*b* and 17*c* are a particular application of corresponding FIGS. 10*a*, 10*b* and 10*c*, wherein the folding lines have been replaced by linear rigid elements. The repetition shown in FIG. 17*a* corresponds to the one of FIG. 10*a*, the plan view of FIG. 17*b* corresponds to the view of FIG. 10*b* , the structure in perspective of FIG. 17*c* corresponds to the structure of FIG. 10*c*.

Figure 18:
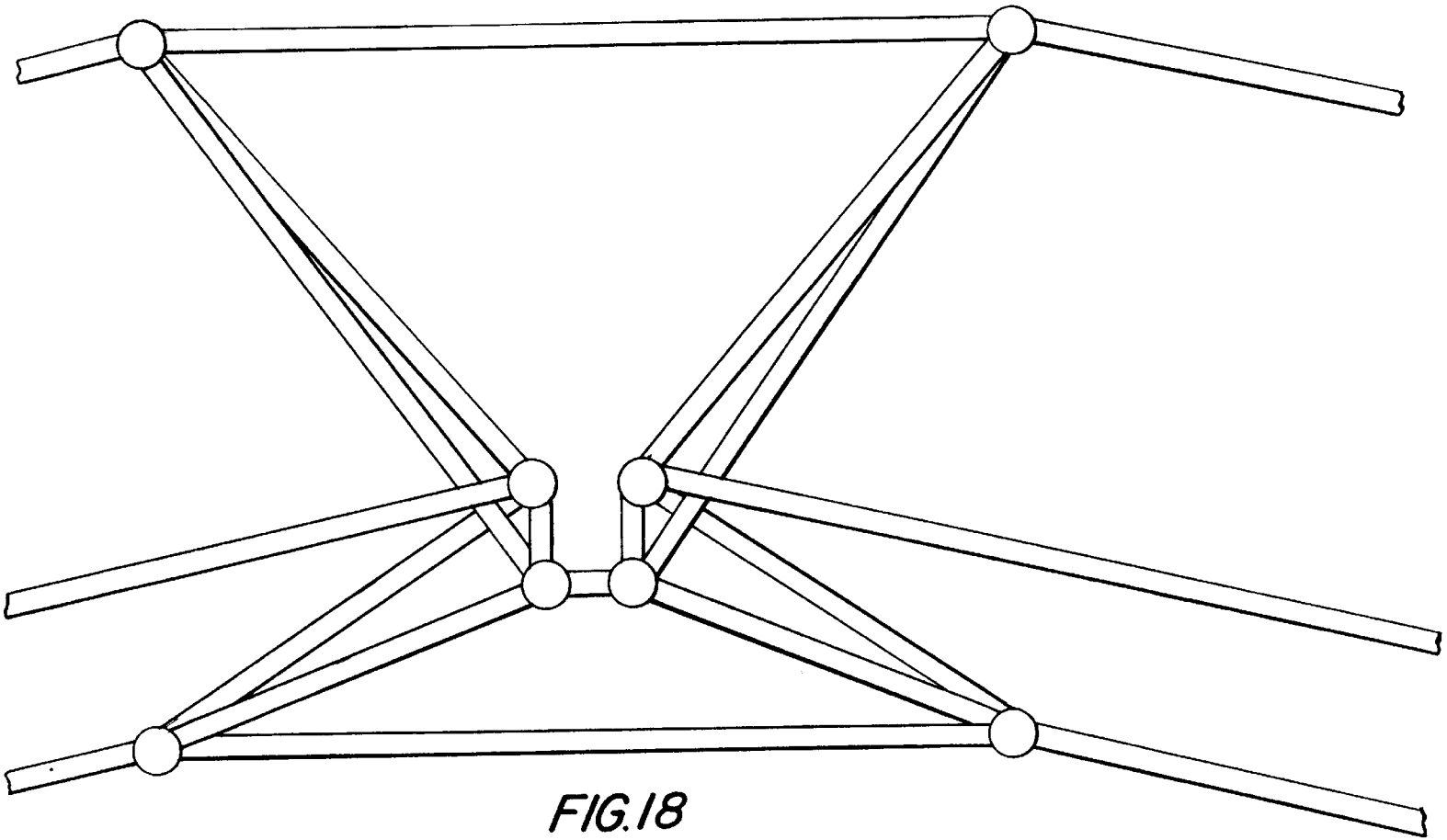
FIG. 18 shows the circled part of FIG. 17*c*.

FIG. 18 shows in better detail the circled part og FIG. 17*c*.

Figure 19:
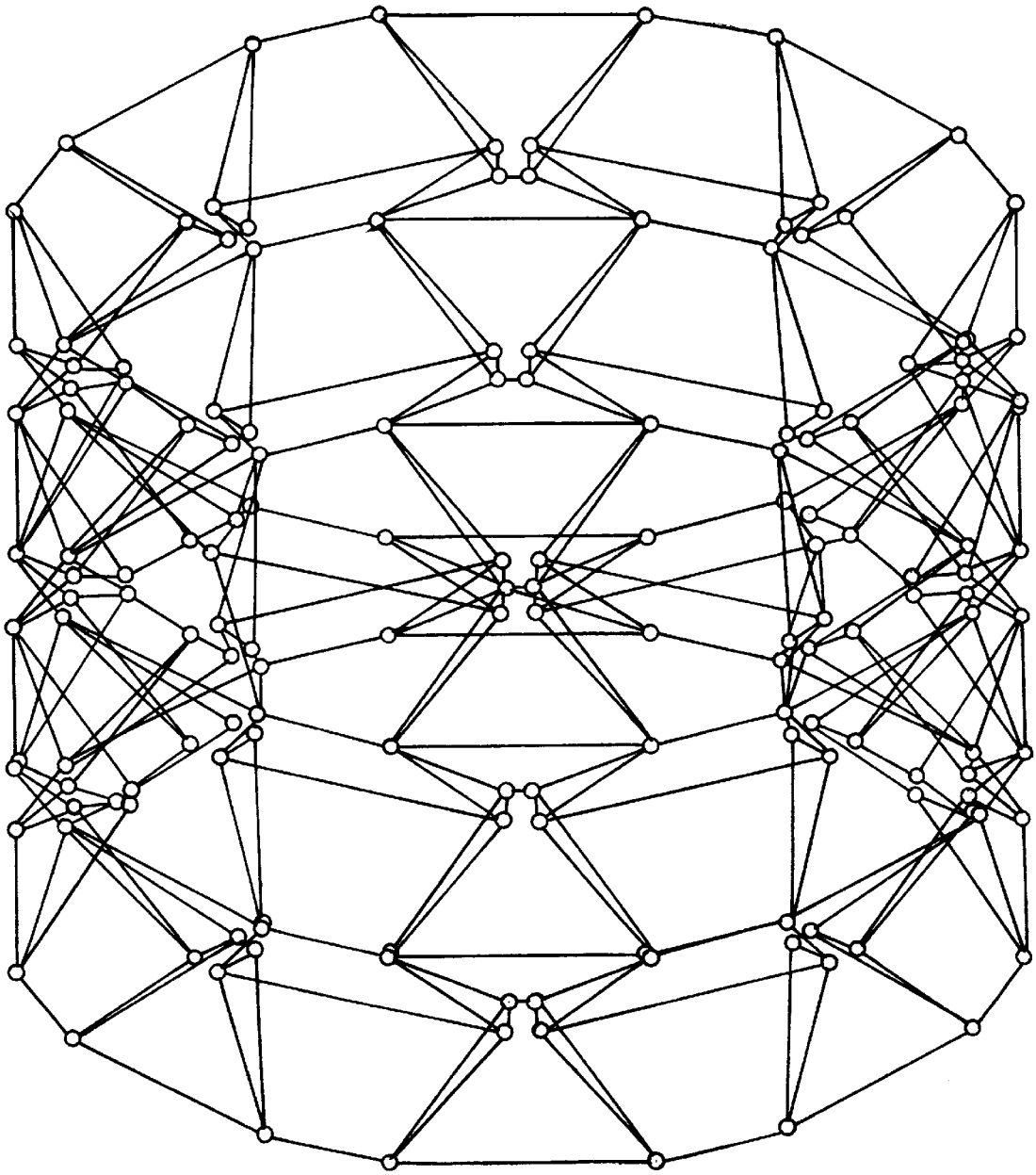
FIG. 19 shows a particular repetition of the structure of FIG. 17*c*.

FIG. 19 shows in perspective the structure of FIG. 17*c*, longitudinally repeated in the space.

A further application of the folding method according to the invention is illustrated in FIGS. 20*a* and 20*b*. In this case the surface to be folded is constituted by a net. In particular, FIG. 20*a* corresponds to FIG. 9*a* and FIG. 20*b* corresponds to FIG. 9*c*, when the surface is a net.

The application of the folding method to micro- and macro-reticular surfaces, as illustrated in FIGS. 20*a* and 20*b*, confers to that surfaces great extension and flexibility, strength, containment capability and corresponding volume reduction, when needed.

I claim:

1. A method for folding a planar surface comprising the steps of:

(a) forming a series of parallel folding lines on said surface, the number of said parallel folding lines being an odd integer greater than 3;

(b) linking a first parallel folding line with a next adjacent parallel folding line through primary and secondary folding lines having a common origin on said first parallel folding line and diverging from each other, so that said primary folding line forms an angle $\beta$, with $0<\beta<90°$ with respect to a line perpendicular to said parallel folding lines and said secondary folding line forms an angle $\Gamma$, with $\beta<\Gamma<90°$ with respect to said same perpendicular, said primary and secondary folding lines being specularly arranged with respect to the next adjacent parallel folding lines and respectively defining opposite directions of folding with respect to each other; and (c) folding said planar surface along said parallel folding lines such that each parallel folding line is directionally opposite the next adjacent parallel folding line so as to assume an accordion shape, while folding said primary and secondary folding lines in their respectively opposite directions to collapse adjacent planar surface portions on themselves in directions perpendicular to said folding lines without distortion due to the specular arrangement of the primary and secondary folding lines.

2. The method according to claim 1, further comprising repeating step (b) such that the common origins are equally spaced from each other.

3. The method according to claim 1, further comprising providing additional primary and secondary folding lines specularly arranged with respect to the perpendicular to said parallel folding lines.

4. The method according to claim 1, wherein said primary and secondary folding lines are repeated in progression.

5. The method according to claim 1, wherein said angle β is about 15° and said angle Γ is about 45°.

6. The method according to claim 1, wherein said angle β is about 20° and said angle Γ is about 45°.

7. The method according to claim 1, wherein said angle β is about 22° and said angle Γ is about 45°.

8. The method according to claim 1, wherein said angle β is about 30° and said angle Γ is about 45°.

9. The method according to claim 1, wherein said angle β is about 35° and said angle Γ is about 45°.

10. The method according to claim 1, wherein said primary and secondary folding lines are repeated in symmetry.

11. The method according to claim 10, wherein said angle β is about 30° and said angle Γ is about 60°.

12. The method according to claim 3, wherein each pair of said specularly arranged additional primary and secondary folding lines have the same origin.

13. The method according to claim 12, wherein said primary and secondary folding lines are repeated in symmetry.

14. The method according to claim 12, wherein said primary and secondary folding lines are repeated in progression.

15. The method according to claim 12, wherein said angle β is about 15° and said angle Γ is about 45°.

16. The method according to claim 1, wherein said planar surface is a reticular surface.

17. The method according to claim 16, wherein said planar surface is a reticular surface.

18. The method according to claim 17, wherein said planar surface is a reticular surface.

19. The method according to claim 18, wherein said planar surface is a reticular surface.

20. The method according to claim 19, wherein said planar surface is a reticular surface.

21. A method for folding a sheet material having a flat planar and continuous surface comprising the steps of;

(a) forming a series of equally spaced parallel folding lines on said surface, the number of said parallel folding lines being an odd integer greater than 3;

(b) linking a first parallel folding line with a next adjacent parallel folding line through primary and secondary folding lines having a common origin on said first parallel folding line and diverging from each other, so that the primary folding line forms an angle β, with $0<\beta<90°$ with respect to a line perpendicular to said parallel folding lines and said secondary folding line forms an angle Γ, with $\beta<\Gamma<90°$ with respect to said same perpendicular, said primary and secondary folding lines being specularly arranged with respect to the next subsequent parallel line and respectively defining opposite directions of folding with respect to each other; and (c) folding said material along said parallel folding lines in successively opposite directions such that the material assumes a generally accordion shape, while folding said primary and secondary folding lines in their respectively opposite directions to collapse adjacent material portions on themselves in directions generally perpendicular to said folding lines without distortion, due to the specular arrangement of said primary and secondary folding lines.

22. A method for folding a sheet material having a flat planar and continuous surface comprising the steps of:

(a) forming a series of equally spaced parallel folding lines on said surface, the number of said parallel folding lines being an odd integer greater than 3, each said parallel folding lines defining a fold opposite the next adjacent folds;

(b) linking a first parallel folding line with a next adjacent parallel folding line with primary and secondary folding lines having a common origin on said first parallel folding line and diverging from each other, so that said primary folding line forms an angle β, with $0<\beta<90°$ with respect to a line perpendicular to said parallel folding lines and said secondary folding line forms an angle Γ, with $\beta<\Gamma<90°$ with respect to said same perpendicular, said primary and secondary folding lines being specularly arranged with respect to the next adjacent parallel folding lines and respectively defining opposite directions of folding with respect to each other;

(c) forming additional primary and secondary folding lines repeated in symmetry;

(d) forming additional primary and secondary folding lines repeated in progression; and (e) folding said material along said parallel folding lines such that each parallel fold is directionally opposite the next adjacent parallel fold so as to assume an accordion shape, while folding said primary and secondary folding lines in their successively opposite directions to collapse adjacent material portions on themselves in directions generally perpendicular to the folding lines without distortion due to the specular arrangement of the primary and secondary folding lines.

* * * * *